US007988432B2

(12) United States Patent
Bae et al.

(10) Patent No.: US 7,988,432 B2
(45) Date of Patent: Aug. 2, 2011

(54) ROTARY COMPRESSOR FOR CHANGING COMPRESSION CAPACITY

(75) Inventors: Ji Young Bae, Busan (KR); Chul Gi Roh, Changwon-Si (KR); Kyoung Jun Park, Changwon-Si (KR); Chang Yong Jang, Gwangju (KR); Jong Bong Kim, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 1207 days.

(21) Appl. No.: 10/556,315

(22) PCT Filed: Apr. 26, 2004

(86) PCT No.: PCT/KR2004/000956

§ 371 (c)(1),
(2), (4) Date: Feb. 12, 2007

(87) PCT Pub. No.: WO2004/101999

PCT Pub. Date: Nov. 25, 2004

(65) Prior Publication Data

US 2008/0107556 A1 May 8, 2008

(30) Foreign Application Priority Data

May 13, 2003 (KR) ..... 10-2003-0030308

(51) Int. Cl.
*F04C 2/00* (2006.01)
*F04C 28/18* (2006.01)

(52) U.S. Cl. ..... 418/32; 418/11; 418/23; 418/60; 418/270; 417/218; 417/326; 137/625.21

(58) Field of Classification Search ..... 418/32, 418/11, 23, 60, 63, 270; 417/218, 221, 223, 417/212, 315; 137/625.21; 251/175, 180
See application file for complete search history.

(56) References Cited

U.S. PATENT DOCUMENTS 3,742,979 A * 7/1973 Woodling ..... 137/625.24
4,598,559 A 7/1986 Tomayko et al.

FOREIGN PATENT DOCUMENTS

JP 62126290 A * 6/1987 ..... 418/63
JP 63032192 A * 2/1988 ..... 418/63

* cited by examiner

*Primary Examiner* — Theresa Trieu
(74) *Attorney, Agent, or Firm* — Birch, Stewart, Kolasch & Birch, LLP

(57) ABSTRACT

A rotary compressor has two compression capacities according to two different rotational directions of the driving shaft. The rotary compressor includes a driving shaft with an eccentric portion. A roller rotates on the shaft along an inner circumference of the cylinder. A vane installed in the cylinder continuously contacts the roller. An upper and a lower bearing are respectively disposed on the top and bottom of the cylinder. A disc shaped valve rotates between two positions and has at least one suction port for selectively supplying refrigerant inside the compression chamber according to the rotational direction of the driving shaft and at least one discharge port communicates with the compression chamber for discharging the compressed refrigerant. The refrigerant is supplied through a communication hole to a port formed on the outer valve.

52 Claims, 30 Drawing Sheets

ROTARY COMPRESSOR FOR CHANGING COMPRESSION CAPACITY

TECHNICAL FIELD

The present invention relates to a rotary compressor, and more particularly, to a rotary compressor that can be operated at different compression capacities and enables a precise location change of components every compressive capacity.

BACKGROUND ART

In general, compressors are machines that are supplied power from a power generator such as electric motor, turbine or the like and apply compressive work to a working fluid, such as air or refrigerant to elevate the pressure of the working fluid. Such compressors are widely used in a variety of applications, from electric home appliances such as air conditioners, refrigerators and the like to industrial plants.

The compressors are classified into two types according to their compressing methods: a positive displacement compressor, and a dynamic compressor (a turbo compressor).

The positive displacement compressor is widely used in industry fields and configured to increase pressure by reducing its volume. The positive displacement compressors can be further classified into a reciprocating compressor and a rotary compressor.

The reciprocating compressor is configured to compress the working fluid using a piston that linearly reciprocates in a cylinder. The reciprocating compressor has an advantage of providing high compression efficiency with a simple structure. However, the reciprocation compressor has a limitation in increasing its rotational speed due to the inertia of the piston and a disadvantage in that a considerable vibration occurs due to the inertial force.

The rotary compressor is configured to compress working fluid using a roller eccentrically revolving along an inner circumference of the cylinder, and has an advantage of obtaining high compression efficiency at a low speed compared with the reciprocating compressor, thereby reducing noise and vibration.

However, in spite of the aforementioned advantages, the rotary compressor has a structural limitation not allowing the roller to revolve in both directions. In other words, the conventional rotary compressor is provided with only a single suction port and a single discharge port, which communicate with the cylinder. The roller performs its rolling motion from an inlet side to an outlet side along the inner circumference of the cylinder to compress the working fluid, such as refrigerant. Accordingly, when the roller performs its rolling motion in a reverse direction, i.e., from the outlet side to the inlet side, it is impossible to compress the working fluid.

Furthermore, the aforementioned structure of the conventional compressor makes it impossible to vary its compression capacity. Recently, there are appearing compressors in which the compression capacity is variably changed so as to correspond to a variety of operational conditions of air conditions. However, the conventional rotary compressor has a limitation in its application since it has only a single compression capacity.

DISCLOSURE OF THE INVENTION

Accordingly, the present invention is directed to a rotary compressor that substantially obviates one or more problems due to limitations and disadvantages of the related art.

An object of the present invention is to provide a rotary compressor enabling operations to obtain different refrigerant compression ratios.

Another object of the present invention is to provide a rotary compressor in which oil inflow into the compression chamber is in advance cut off to prevent the compression efficiency from being lowered.

A further object of the present invention is to provide a rotary compressor in which a dead area that may be incurred in the compression space is completely eliminated to obtain a desired compression efficiency with accuracy.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and according to the purpose of the invention, as embodied and broadly described herein, there is provided a rotary compressor. The rotary compressor includes: a cylinder having a vane for partitioning an inner space of the cylinder into a compression section and a suction section; upper and lower bearings respectively disposed on top and bottom of the cylinder, for defining a compression chamber by hermetically sealing the inner space of the cylinder; a crankshaft installed to penetrate the cylinder, the upper bearing, and having an eccentric portion at an outer circumference thereof; at least one discharge port communicating with the compression chamber, and through which compressed refrigerant is discharged; and a valve assembly having at least one suction port for selectively supplying refrigerant through two different positions inside the compression chamber according to the rotational direction of the crankshaft, and at lease one refrigerant flowing portion for feeding the refrigerant to the suction port.

In other words, the rotary compressor of the present invention is designed to operate in a variety of modes having different compression capacities. In particular, a fluid passage through which refrigerant flows is formed in the valve assembly itself, thereby enabling a smooth refrigerant supply to a selected location.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
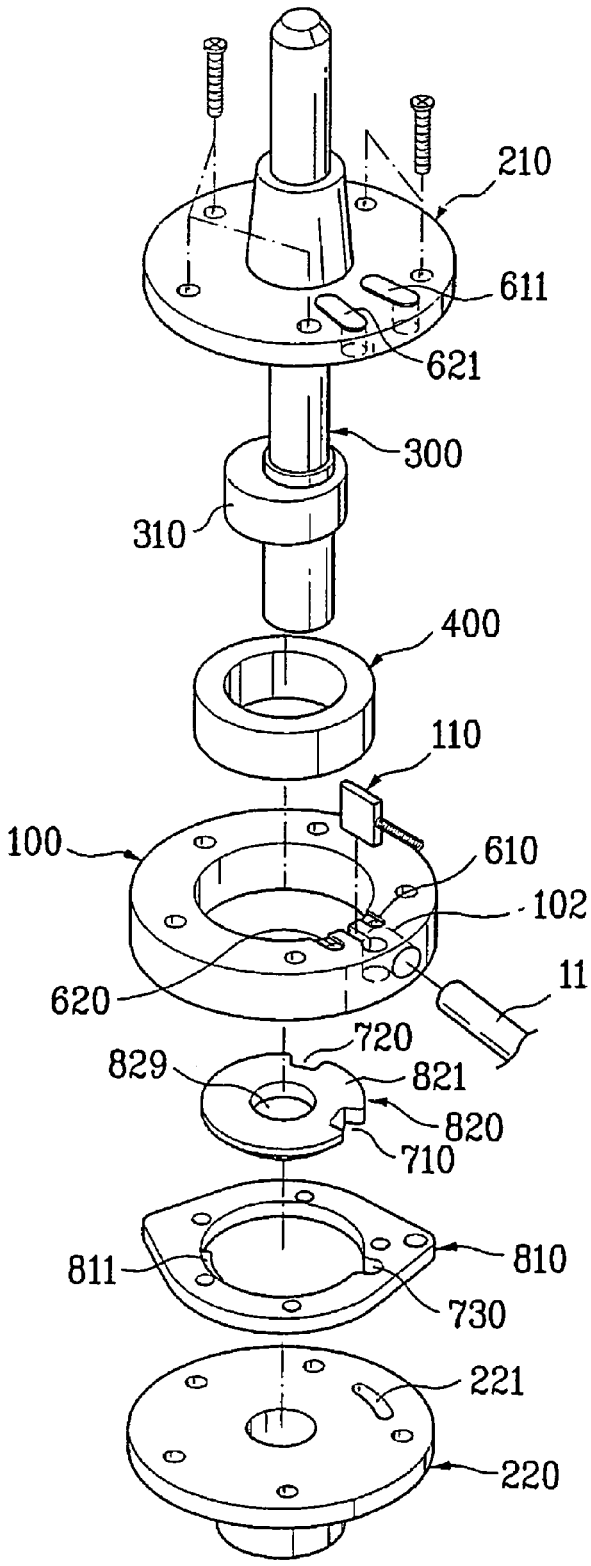
FIG. 1 is an exploded perspective view of a rotary compressor according to a first embodiment of the present invention.

Referring first to FIG. 1, a compressor of a first embodiment of the present invention includes a cylinder 100, an upper bearing 210, a lower bearing 220, a crankshaft 300, a roller 400, a discharge port and a valve assembly.

The cylinder 100 is provided therein with an inner space. A vane 110 is elastically mounted on an inner circumference of the cylinder 100 defining the inner space, so as to be protruded inwardly. The vane 110 always contacts an outer circumference of the roller 400 and thereby it is configured to divide the inner space of the cylinder 100 into a refrigerant compression section and a refrigerant suction section.

The upper and lower bearings 210 and 220 are respectively disposed above and below the cylinder 100 to define a compression chamber by sealing the inner space, while supporting the crankshaft 300.

The discharge port includes first and second discharge ports 610 and 620, and is configured to penetrate the upper bearing 210 from the upper side of the cylinder 100.

Especially, the discharge ports 610 and 620 are disposed adjacent to the vane 110 on both spaces of the vane in the respective portions of the cylinder 100.

Respectively disposed in the discharge ports 610 and 620 are valves 611 and 621 for selectively discharging a compressed refrigerant.

The valve assembly operates such that a compression capacity of a refrigerant compressed in the compression chamber can be varied according to the rotational direction of the crankshaft 300.

The valve assembly may be provided between the lower bearing 220 and the cylinder 100, as well as between the upper bearing 210 and the cylinder 100. In this embodiment, the valve assembly is provided only between the lower bearing 220 and the cylinder 100.

In particular, the valve assembly includes a hollow stationary valve 810, and a rotational valve 820 having a penetration hole 829 through which the crankshaft 300 penetrates. The valve assembly will be described in more detail hereinafter.

The hollow stationary valve 810 is fixed between the outer peripheries of the lower bearing 220 and the cylinder 100, and the rotational valve 820 is rotatably mounted on an inner circumference of the stationary valve 810.

The rotation of the rotational valve 820 is affected and thus realized by a rolling motion of the roller 400.

In other words, when the roller 400 disposed on top of the rotational valve 820 rolls along the inner circumference of the cylinder 100, fluid existing between a bottom of the roller 400 and a top of the rotational valve 820 flows in a direction where the roller 400 rolls. At this point, due to viscosity of the fluid, the rotational valve 820 rotates in the rotational direction of the roller 400.

The fixing and rotational valves 810 and 820 are configured to have a predetermined thickness.

The fixing and rotational valves 810 and 820 are provided with at least one suction port(s) through which the refrigerant can be selectively fed to the different two sections of the compression chamber 101. The fixing and rotational valves 810 and 820 are further provided with a refrigerant flowing portion.

In the above, the suction port includes first and second suction ports 710 and 720 formed in the rotational valve 820, and a third suction port 730 formed in the stationary valve 810. The first and second suction ports 710 and 720 are formed by cutting away portions of an outer circumference of the rotational valve 820, and are spaced apart from each other by a predetermined distance. The third suction port 730 is formed by indenting a portion of an inner circumference of the stationary valve 810. The distance between the first and second suction ports 710 and 720 may be varied depending on a desired compression ratio that may be varied according to applications of the compressor.

For example, in order to obtain a compression efficiency followed by compressing a refrigerant having a relatively large compression capacity, the compression should be carried out at the closest location to the vane 110. When considering this, the first suction port 710 for a large capacity is positioned in the closest position to one side of the vane 110, and the second suction portion 720 for a small capacity is positioned near the vane at the other side of the vane 110.

Accordingly, the suction ports 710 and 720 are spaced from each other by such a distance that the respective corresponding suction ports 710 and 720 are positioned at the aforementioned locations when the rotational valve 820 is rotated according to the rotational direction of the crankshaft 300.

Furthermore, the third suction port 730 is formed to be placed adjacent to one side of the vane 110 with respect to the installation location of the vane 110, and is supplied with refrigerant from, for example, an accumulator, through a first communication hole 102 formed on the cylinder.

Formed on a lower-inner circumference of the stationary valve 810 is a hook step 811 protruded inwardly, a thickness of which is less than that of the stationary valve 810. Formed on an outer circumference of the rotational valve 820 are at least one, for instance, first stopper 821 and second stopper 822 that are hooked on the hook step 811 according to its rotational direction of the rotational valve 820. In other words, when the rotational valve 820 rotates for an operation of a high capacity refrigerant compression ratio, the first stopper 821 is hooked on the hook stopper 811, and when the rotational valve 820 rotates for an operation of a lower capacity refrigerant compression ratio, the second stopper 822 is hooked on the hook stopper 811.

The first stopper 821 is adjacently disposed between the first and second suction ports 710 and 720, and the second stopper 822 is spaced apart from the first stopper 821 by a predetermined circumferential distance.

Figure 2A:
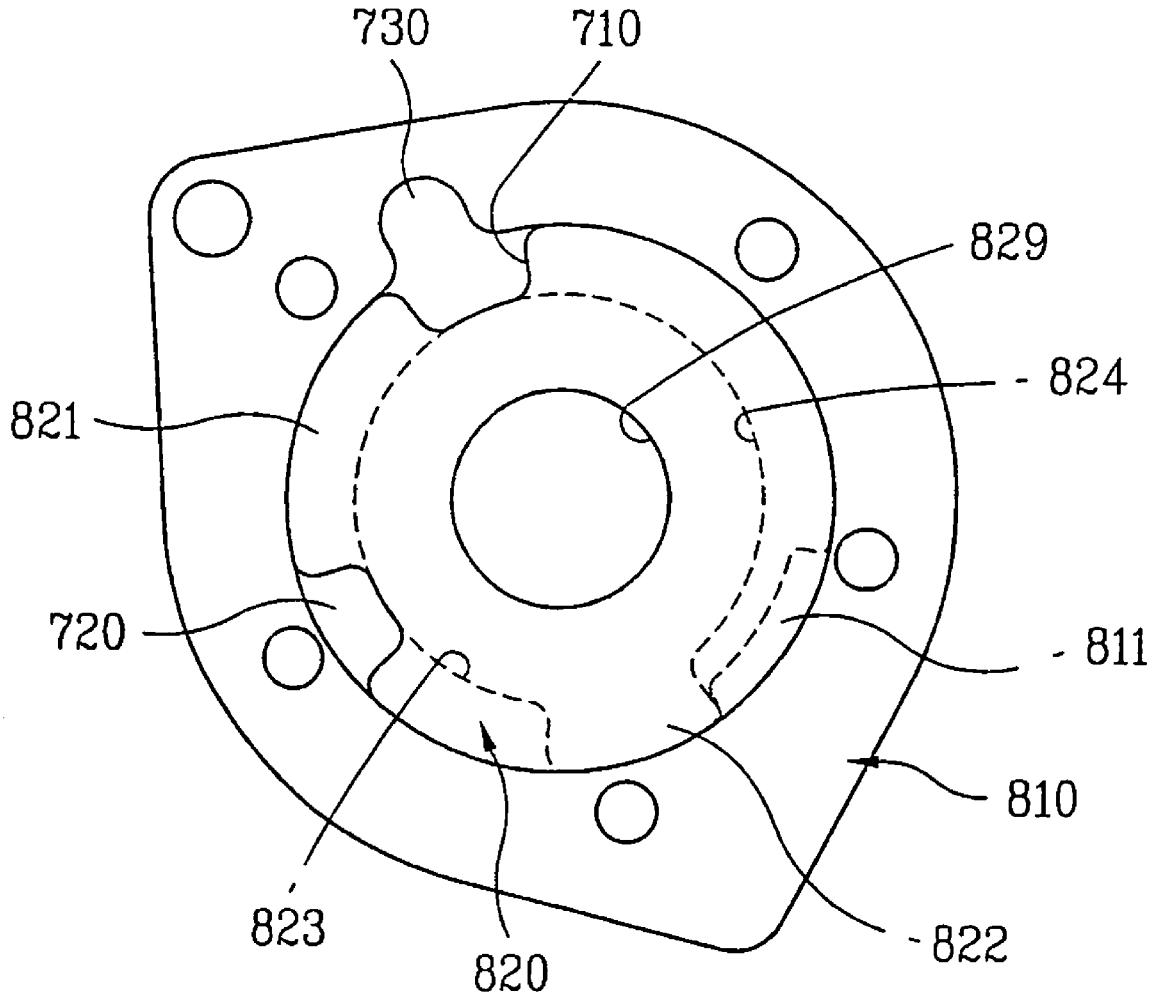
FIG. 2A is a plan view of a valve assembly operated in a high capacity operational mode of a rotary compressor according to a first embodiment of the present invention.
Figure 2B:
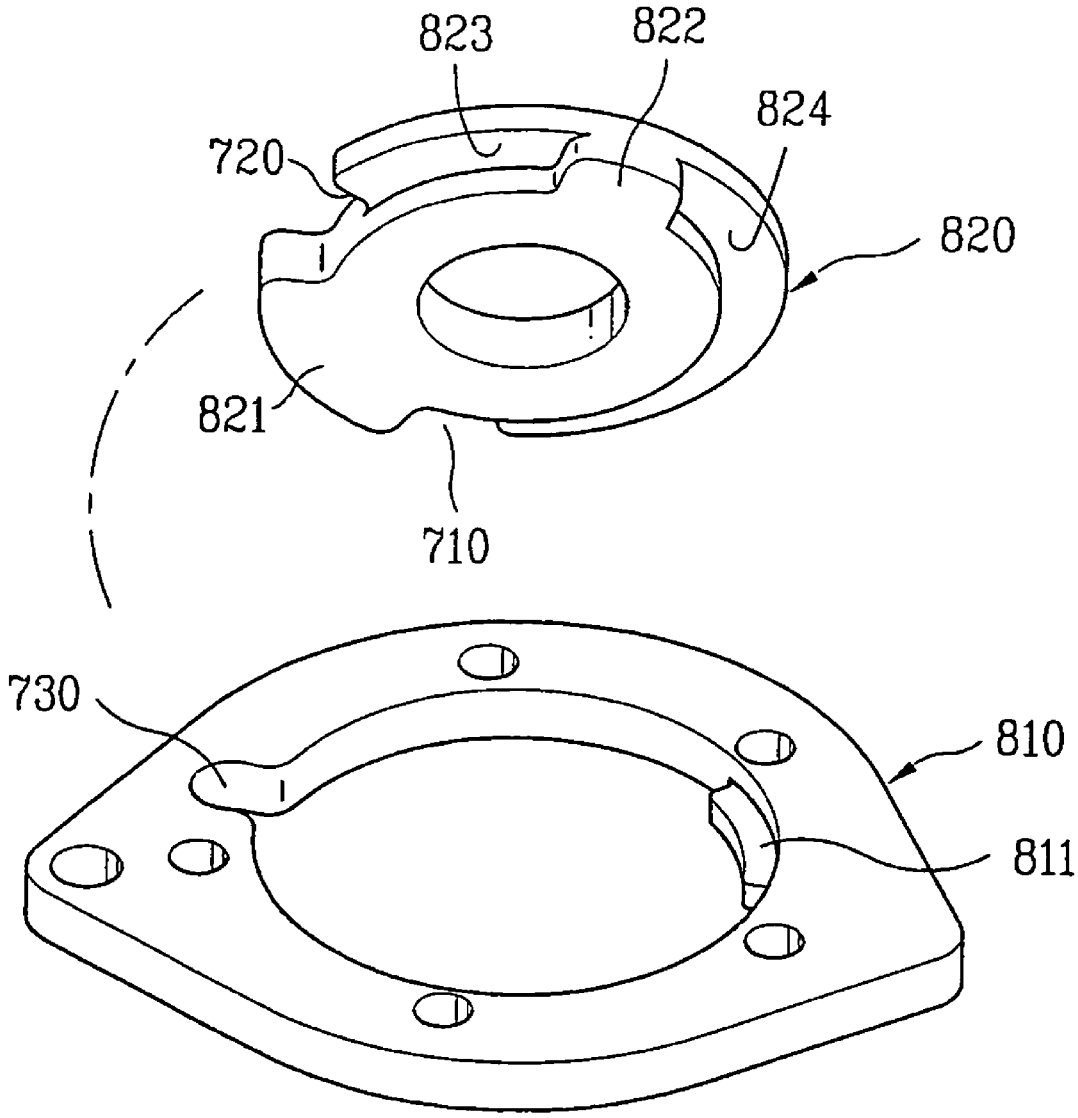
FIG. 2B is an exploded perspective view illustrating an assembled state of a stationary valve and a rotation valve of a valve assembly depicted in FIG. 2A.

Meanwhile, as shown in FIGS. 2A and 2B, the refrigerant flowing portion includes a first refrigerant flowing portion 823 for communicating the third suction port 730 of the stationary valve 810 with the first suction portion 710 of the rotational valve 820 when the rotational valve 820 is rotated to a position for a low capacity operational mode, and a second refrigerant flowing portion 824 for communication from one end of the second stopper 822 to the second suction port 720.

The first and second refrigerant flowing portions 823 and 824 are defined by grooves formed along a circumference periphery of a bottom of the rotational valve 820.

The refrigerant flowing portion further includes a third refrigerant flowing portion 221 formed on the top of the lower bearing 220. The third refrigerant flowing portion 221 is designed corresponding to the location of the second stopper 822 of the rotational valve 820 when the rotational valve 820 is rotated to the low capacity operational mode. In other words, in the low capacity operational mode, the third refrigerant flowing portion 221 allows the third suction port 730 of the stationary valve 810 to communicate with the second suction port 720 of the rotational valve 820.

The operation of the above-described rotary compressor will be described in more detail with reference to FIGS. 2A through 7B hereinafter.

The rotary compressor is designed to selectively operate in either one of low and high capacity operational modes.

When the operation mode of the rotary compressor is set to the high capacity operational mode, the crankshaft 300 rotates counterclockwise in a state where the valve assembly is varied to a state shown in FIGS. 2A and 2B to perform the high capacity compression.

Figure 4A:
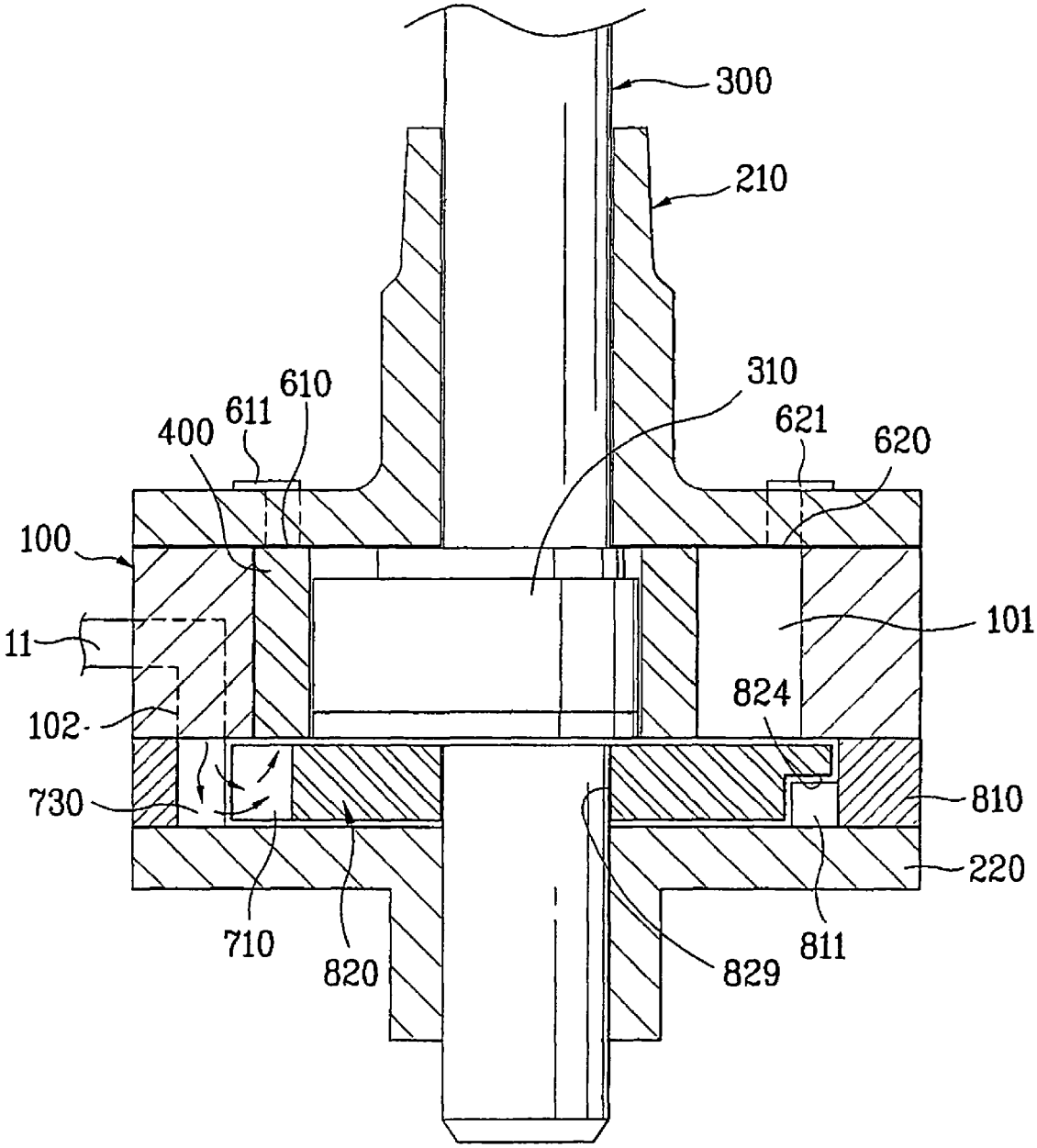
FIG. 4A is a sectional view taken along the line I-I of FIG. 3A.
Figure 4B:
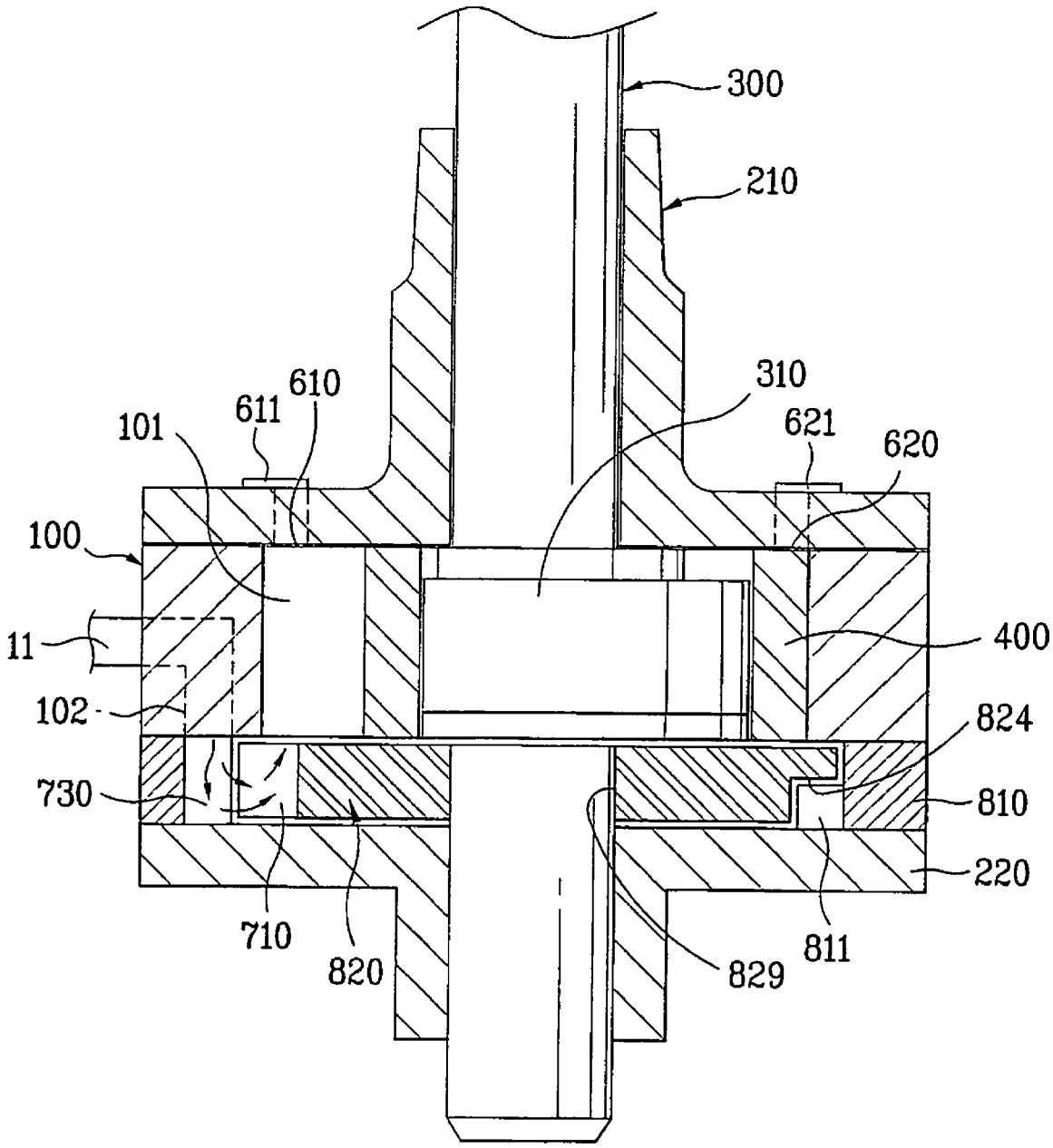
FIG. 4B is a sectional view taken along the line II-II of FIG. 3C.

At this point, the refrigerant fed into the compressor is directed to the third suction port 730 through the first communication hole 102, and the roller 400 mounted around an eccentric portion 310 of the crankshaft 300 eccentrically rotates from a state shown in FIG. 4*a* to a state shown in FIG. 4*b*.

By the rotation of the roller 400, fluid between the bottom of the roller 400 and the rotational valve 820 flows in the rotational direction (counterclockwise) of the roller 400.

At this point, viscosity of the fluid allows the rotational valve 820 to rotate in the rotational direction of the roller 400.

Furthermore, when the first stopper 821 of the rotational valve 820 is caught by the hook step 811 formed on the inner circumference of the stationary valve 810 in the course of moving along the inner circumference of the stationary valve 810, the rotation of the rotational valve 820 stops.

When the rotational valve 820 rotates counterclockwise as described above, the first suction port 710 of the rotational valve 820 communicates with the third suction port 730 of the stationary valve 810. As a result, the refrigerant fed to the third suction port 730 through the first communication hole 102 of the cylinder 100 is directly supplied to the first suction port 710 formed on the rotation valve 820.

At this point, the second suction port 720 formed on the rotational valve 820 and opened to the compression chamber 101 is maintained in a closed state.

Figure 3A:
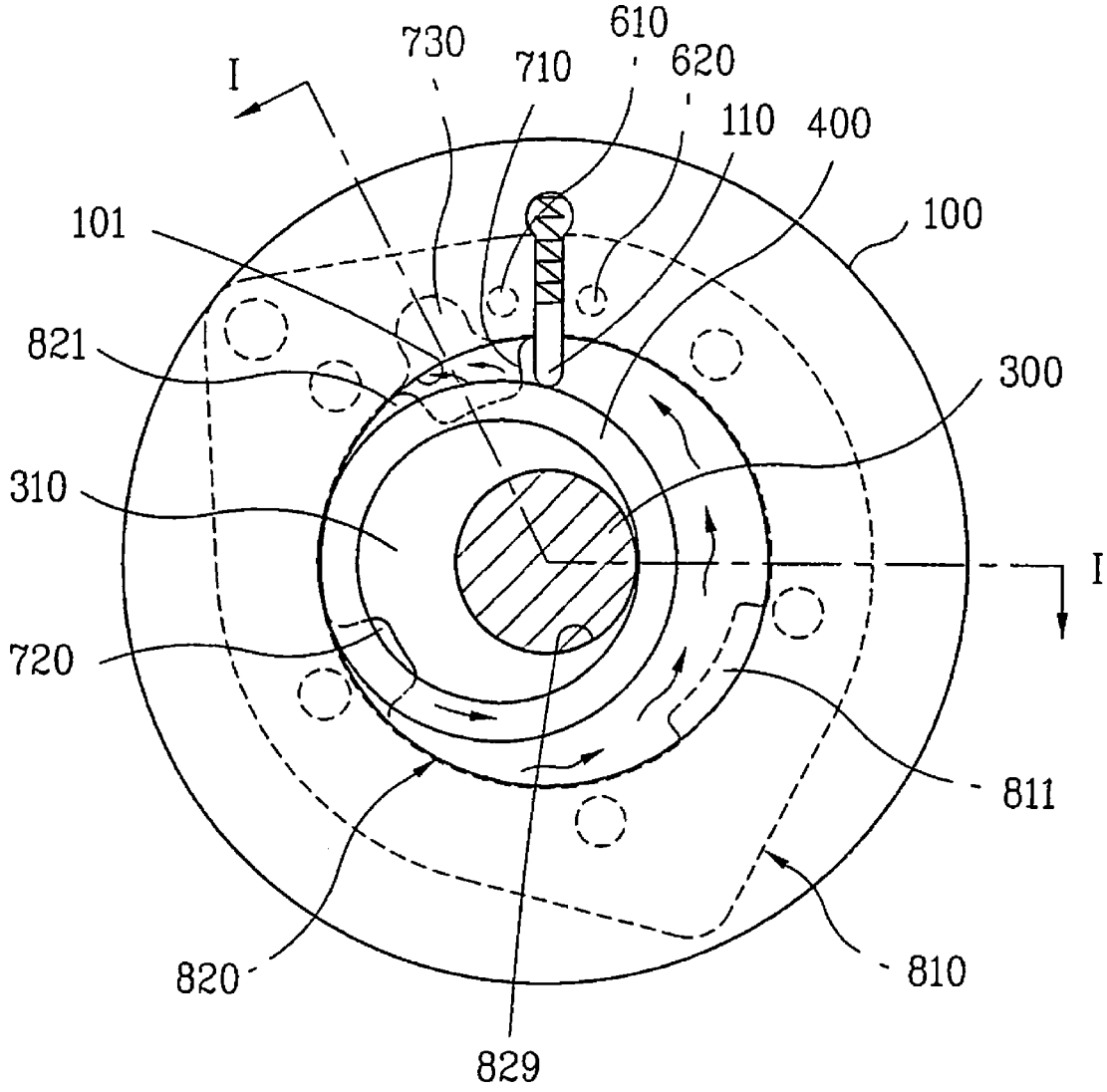
FIGS. 3A to 3C are sectional views illustrating a rotary compressor, which is operated in a high capacity operational mode, according to a first embodiment of the present invention.
Figure 3B:
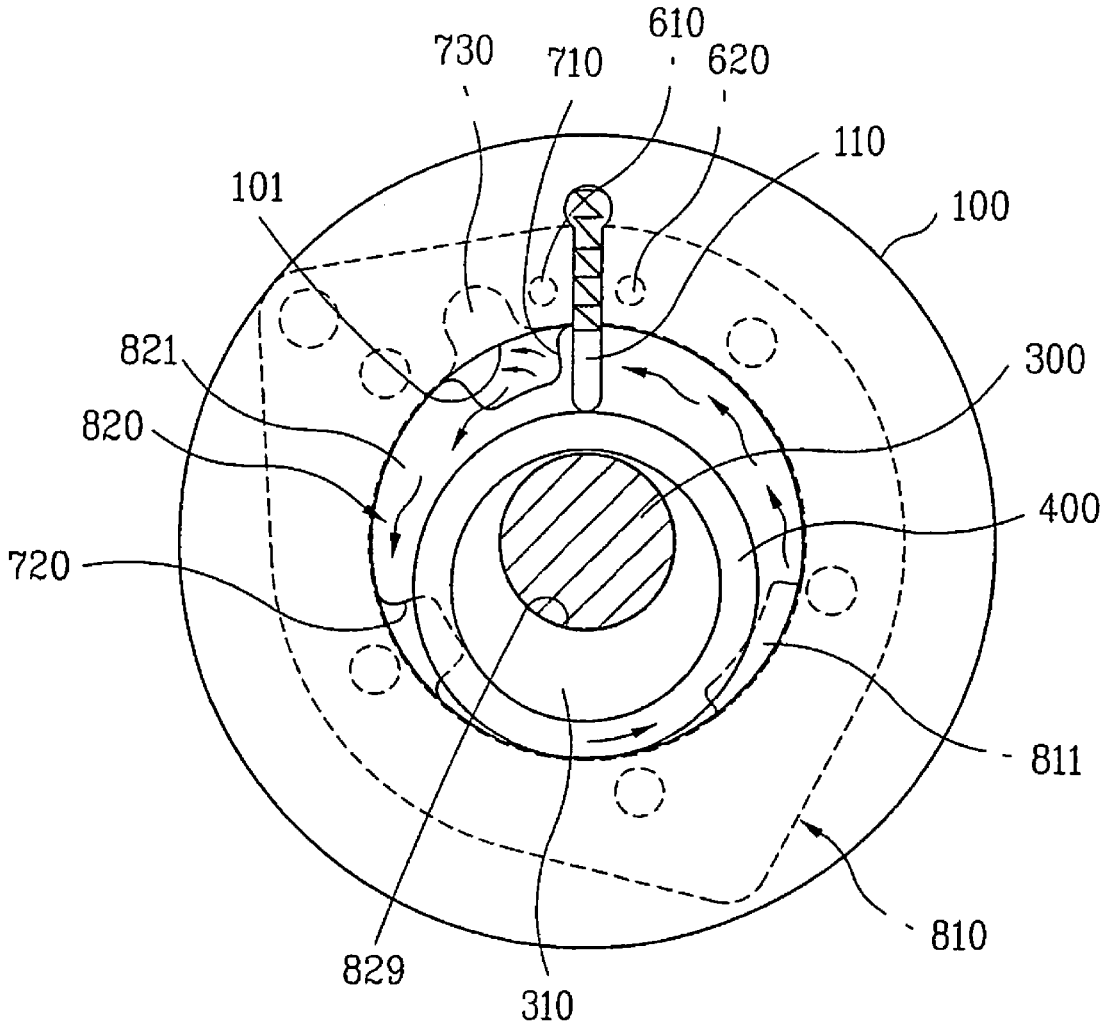

Accordingly, the refrigerant fed to the first suction port 710 is directed to the compression chamber 101 by a pressure difference, and is then further gradually compressed as the roller 400 eccentrically rotates together with the crankshaft 300 and the eccentric portion 310 as shown in FIGS. 3A and 3B.

Figure 3C:
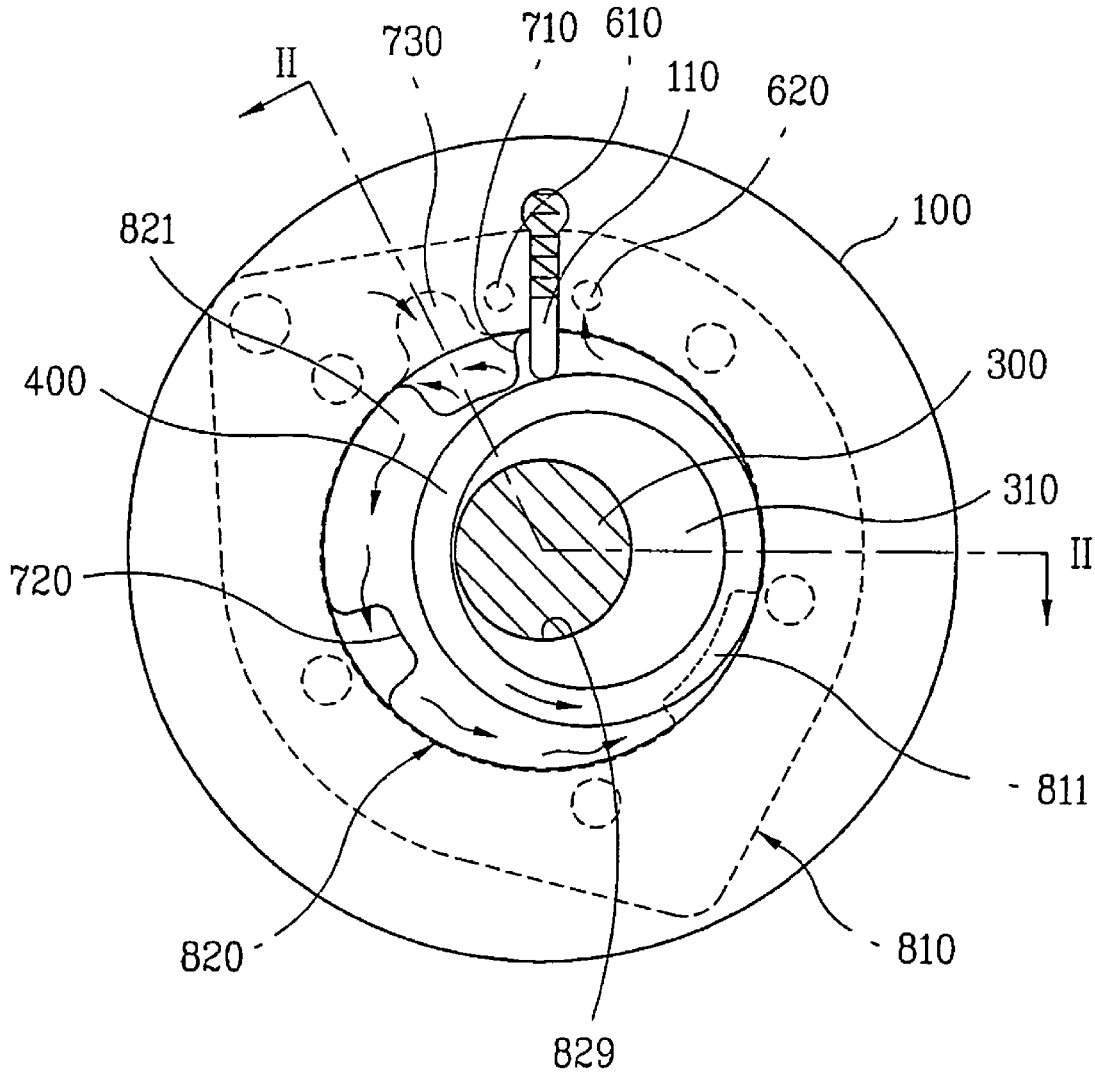

When the compression of the refrigerant is completely realized as shown in FIG. 3C, the second discharge port 620 disposed on a right side of the vane 110 in the drawing is opened to discharge the compressed refrigerant to the outside. At this point, the first discharge port 610 disposed on a left side of the vane in the drawing remains in the closed state.

A series of above-described operating processes are continued unless the operation of the compressor is stopped or reversed.

Figure 5A:
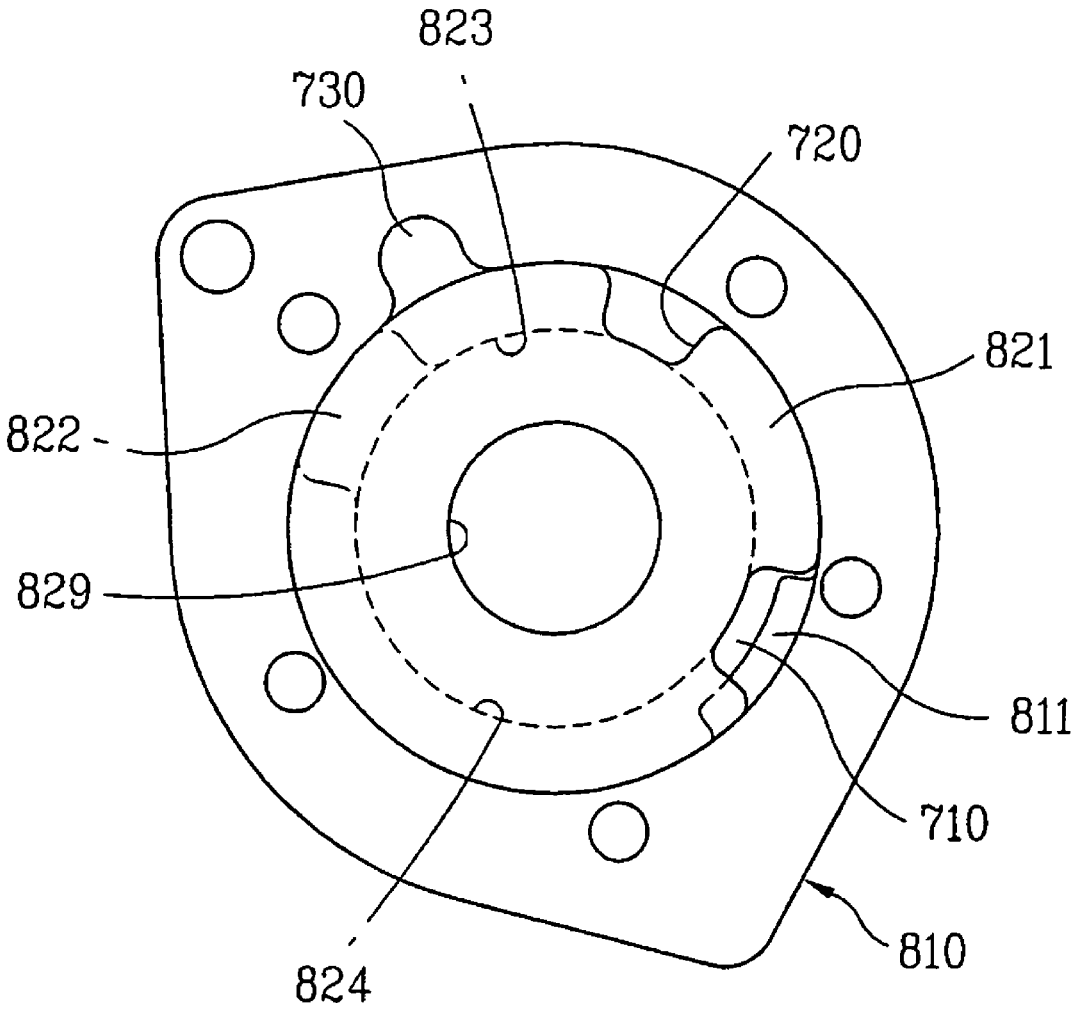
FIG. 5A is a plan view illustrating a valve assembly operated in a low capacity operational mode of a rotary compressor according to a first embodiment of the present invention.
Figure 5B:
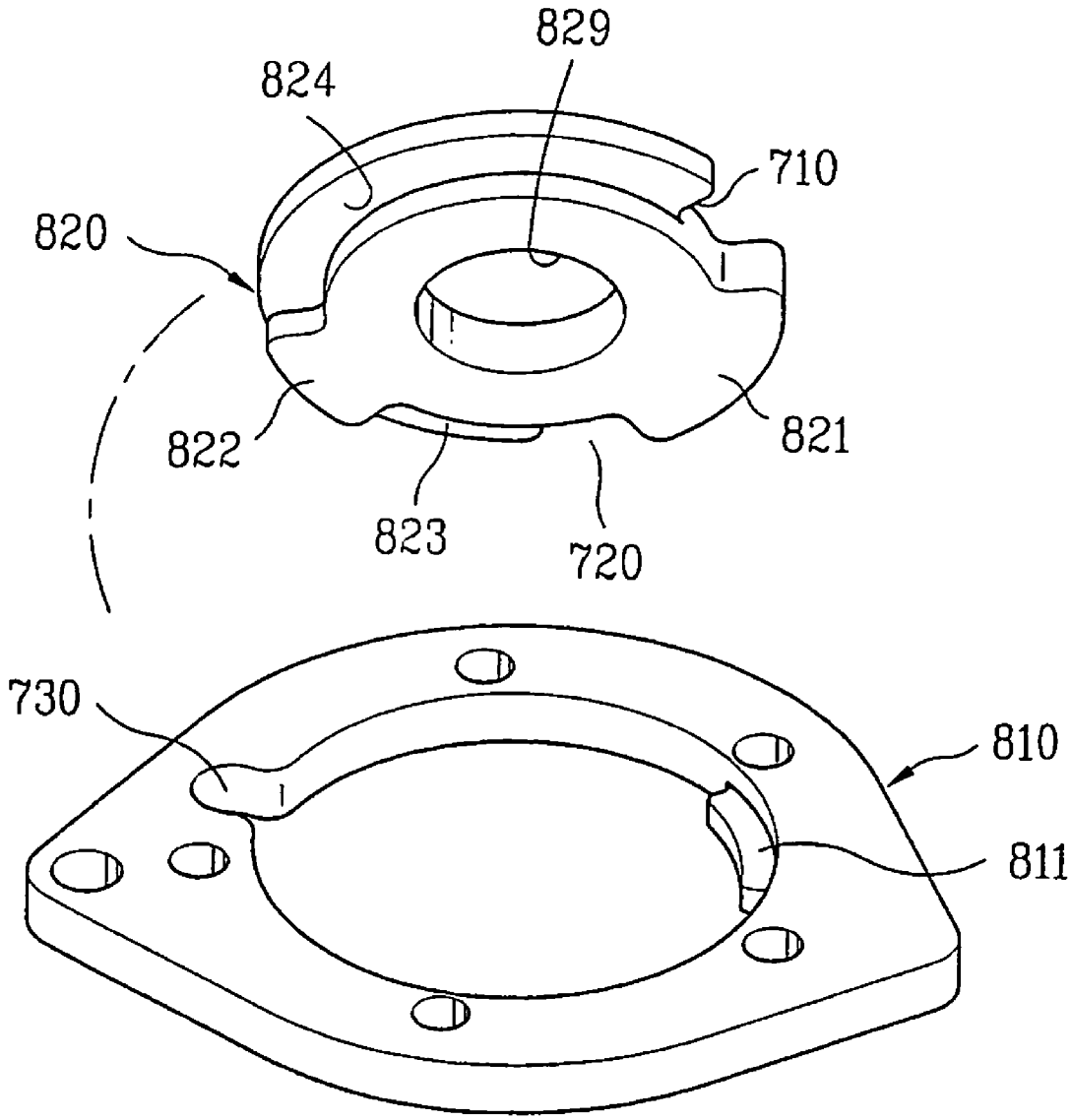
FIG. 5B is an exploded perspective view illustrating an assembled state of a stationary valve and a rotation valve of a valve assembly depicted in FIG. 5A.

When the operation mode is converted into the low capacity operational mode, the valve assembly is rotated to a state shown in FIGS. 5A and 5B, and the crankshaft 300 rotates clockwise.

The rotation of the crankshaft 300 allows the roller 400 to roll along the inner circumference of the compression chamber 101, by which the fluid between the bottom of the roller 400 and the rotational valve 820 flows in the rotational direction of the roller 400. At this point, viscosity of the fluid lets the rotational valve 820 rotate in the rotational direction of the roller 400.

The above process is identical to that in the high capacity operational mode except for the rotational direction of the roller 400 and the flowing direction of the refrigerant.

When the second stopper S21 of the rotational valve 820 is caught by the hook step 811 formed on the inner circumference of the stationary valve 810 in the course of moving along the inner circumference of the stationary valve 810, the rotation of the rotational valve 820 stops.

When the rotational valve 820 rotates clockwise as described above, the space for receiving the refrigerant is defined at a right side of the vane 110 and the space for compression is defined at a left side of the vane 110.

Figure 6A:
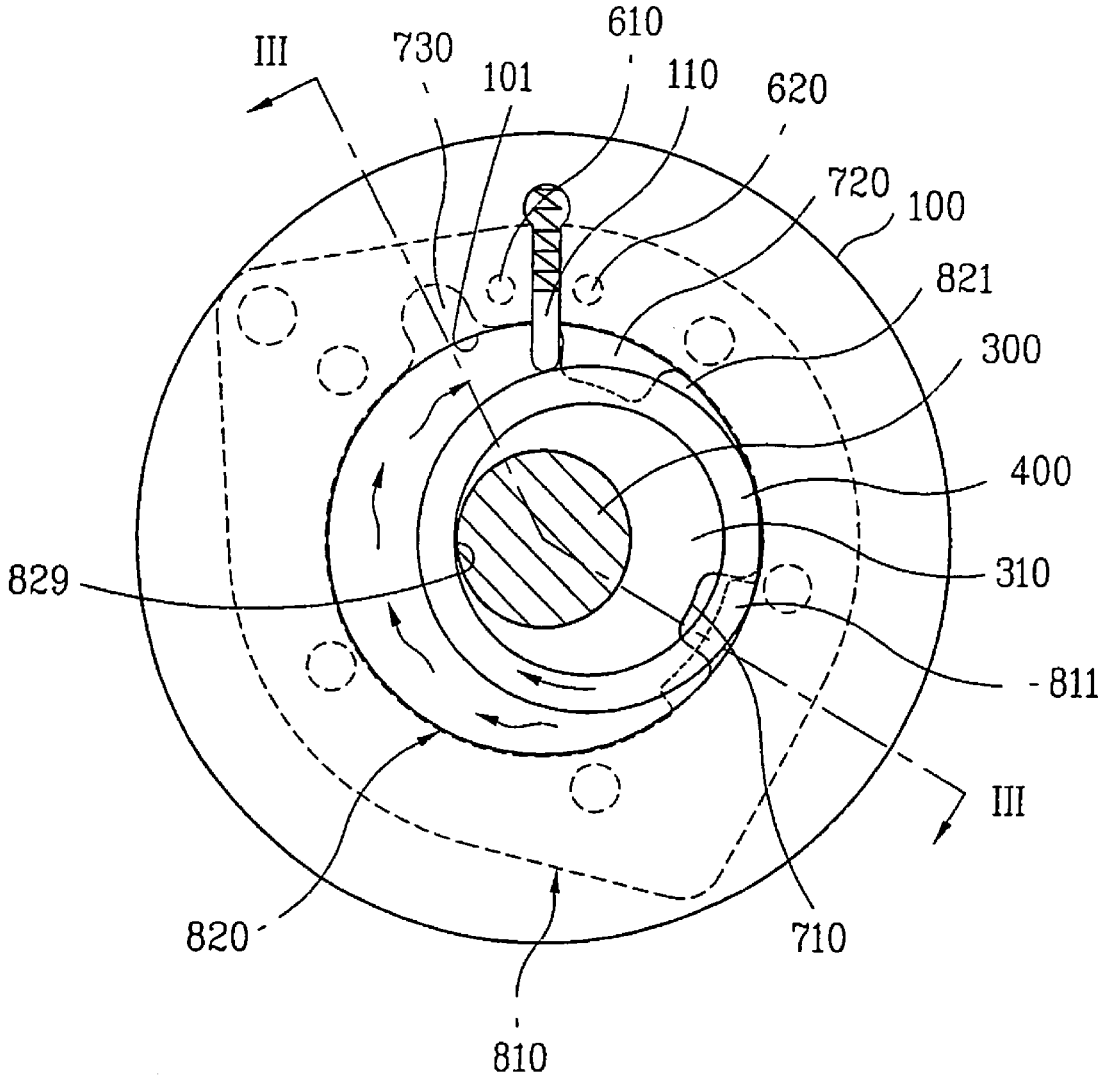
FIGS. 6A to 6C are sectional views illustrating a rotary compressor, which is operated in a low capacity operational mode, according to a first embodiment of the present invention.
Figure 6B:
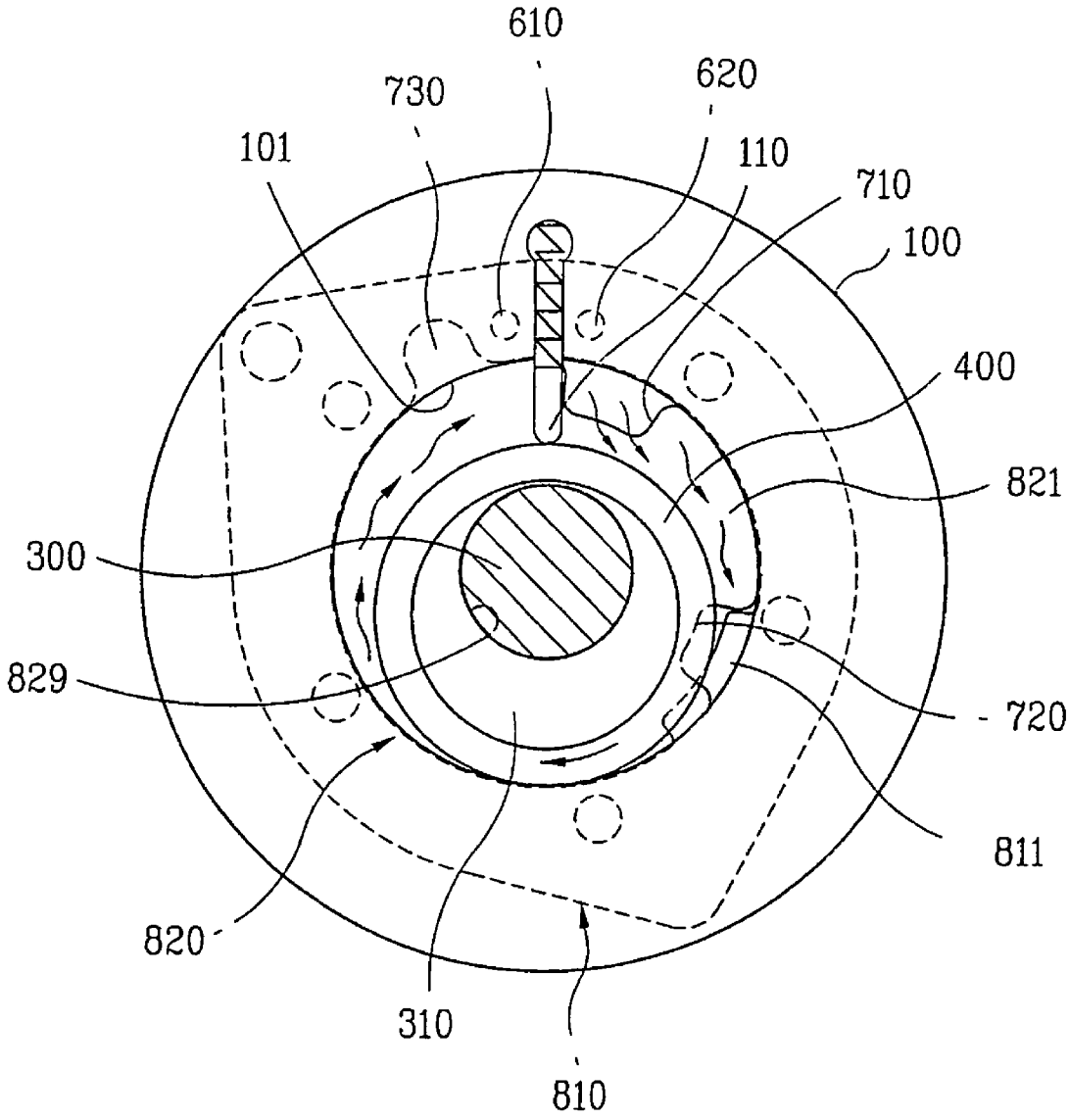

The second suction port 720 of the rotational valve 820 is disposed adjacent to the right side of the vane 110, and the first suction port 710 of the rotational valve 820 is located on a portion corresponding to the hook step 811 of the stationary valve 810 as shown in FIGS. 5A and 6A.

At this point, the second suction port 720 communicates with the third suction port 730 of the stationary valve 810 by the first refrigerant flowing portion 823, and the first suction port 710 communicates with the third suction port 730 of the stationary valve 810 by the second refrigerant flowing portion 824 and the third refrigerant flowing portion 221 formed on the top of the lower bearing 220.

Accordingly, the refrigerant fed to the third suction port 730 through the first communication hole 102 of the cylinder 100 is directed to the second suction port 720 through the first refrigerant flowing portion 823 formed on the rotational valve 820, and is further directed to the compression chamber 101 through the second and third refrigerant flowing portions 824 and 221.

The compression of the refrigerant fed into the compression chamber 101 starts from a point where the roller 400 passes the first suction port 720.

At this point, the refrigerant fed into the compression chamber 101 through the second suction port 720 prevents the inner space of the compression chamber 101 from being under vacuum until it reaches a position where the first suction port 710 communicates after it passes through a position where the vane 110 is located, thereby reducing noise caused by vacuum and improving the compression efficiency.

Figure 6C:
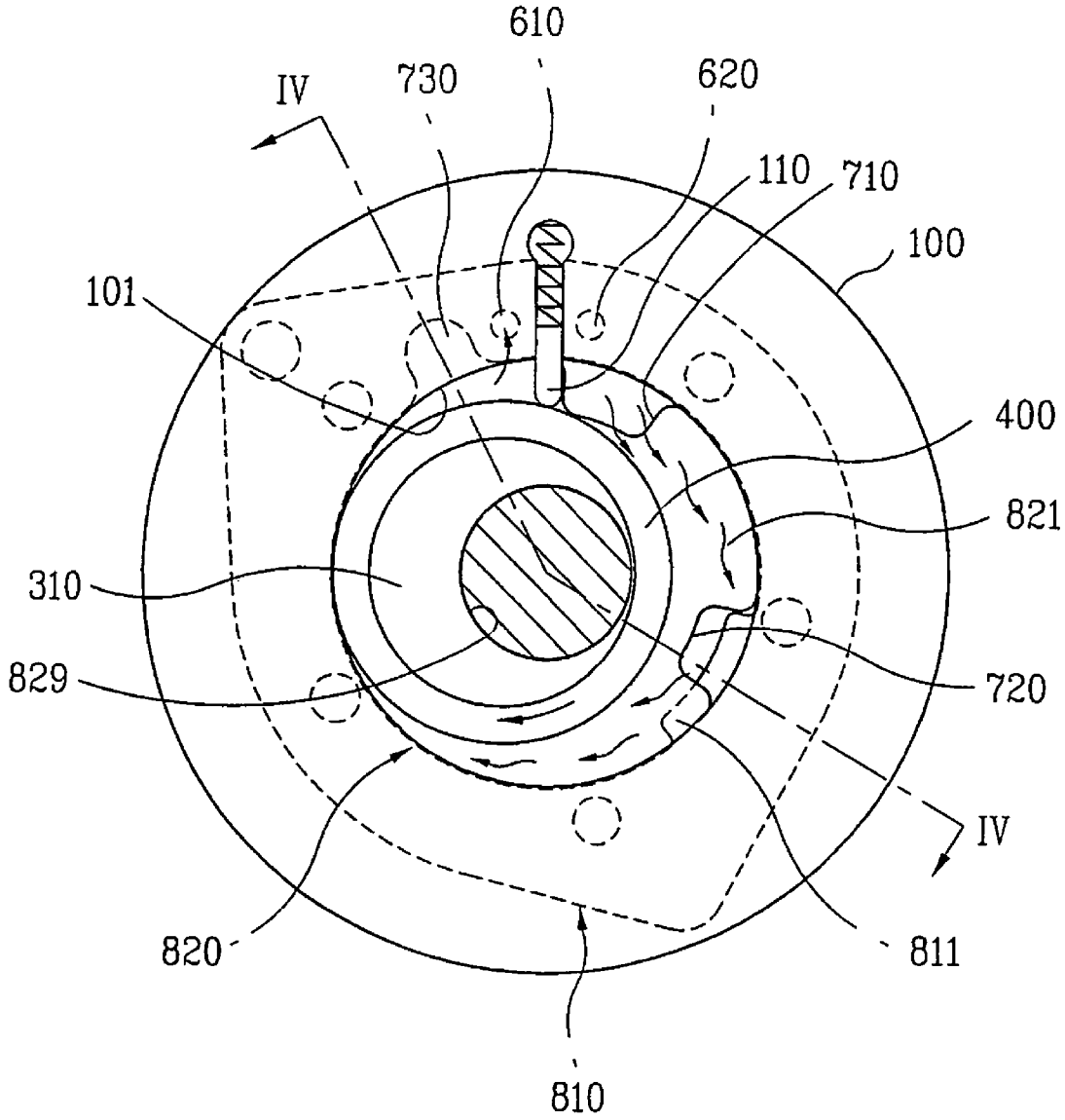
Figure 7A:
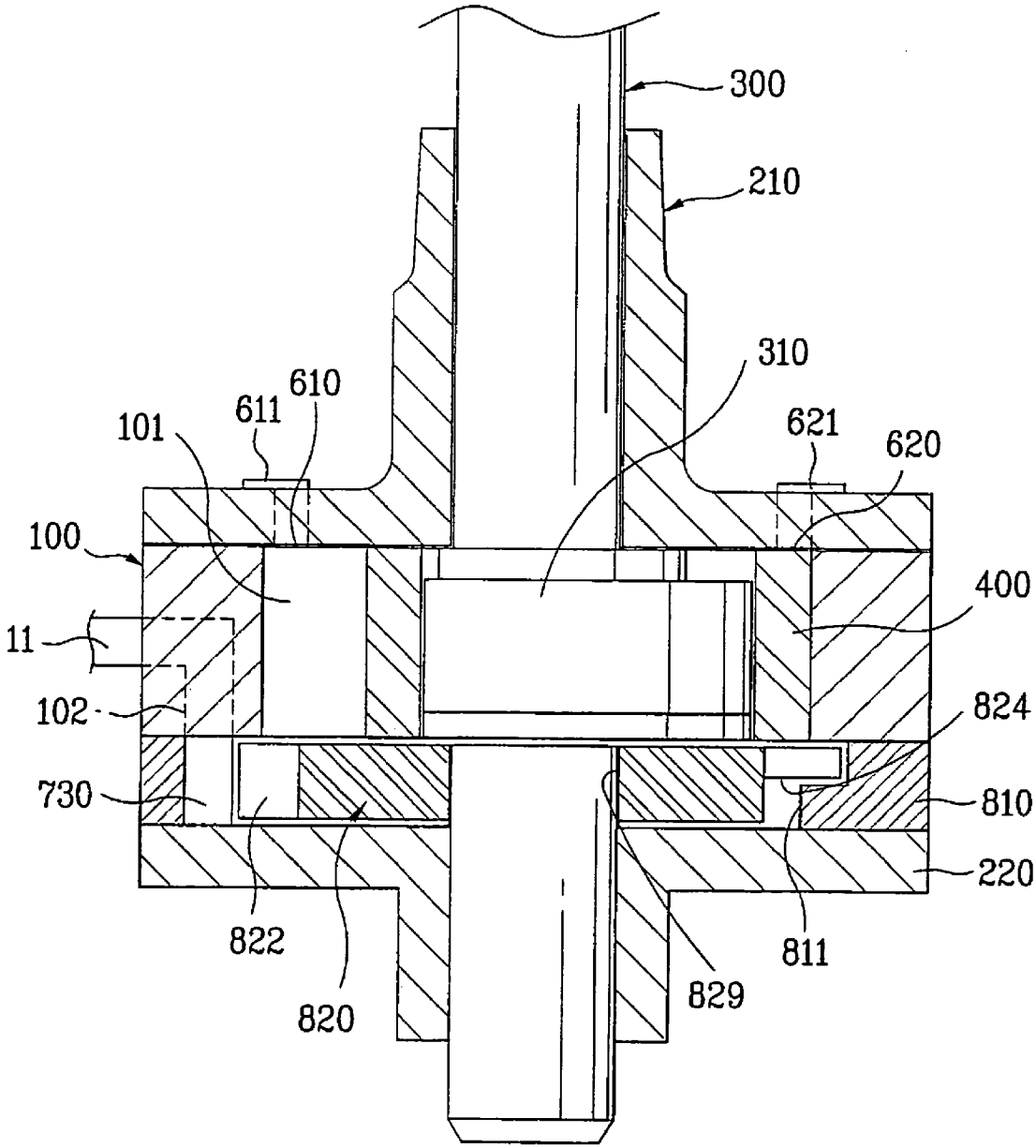
FIG. 7A is a sectional view taken along the line III-III of FIG. 6A.
Figure 7B:
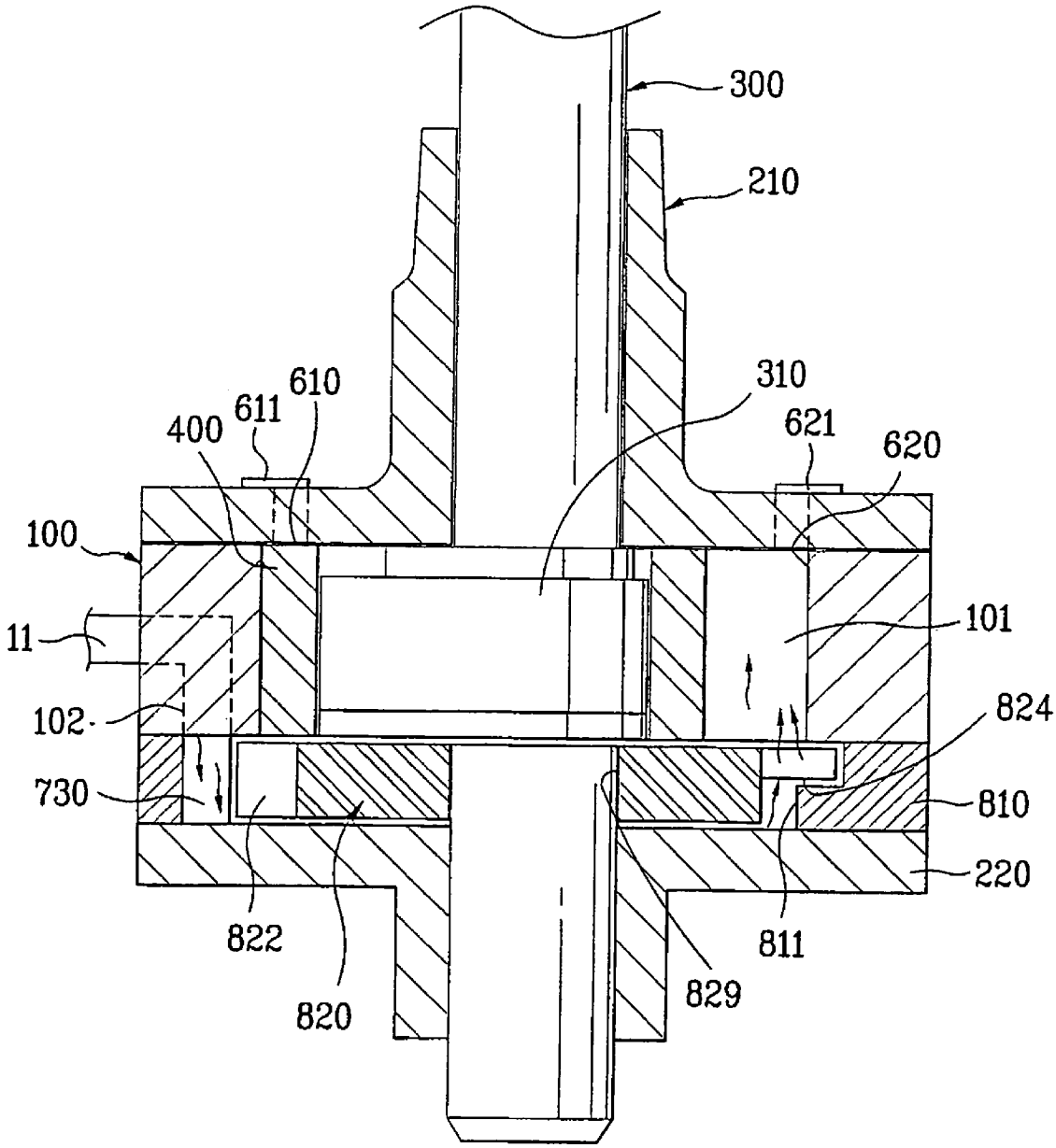
FIG. 7B is a sectional view taken along the line IV-IV of FIG. 6C.
Figure 8:
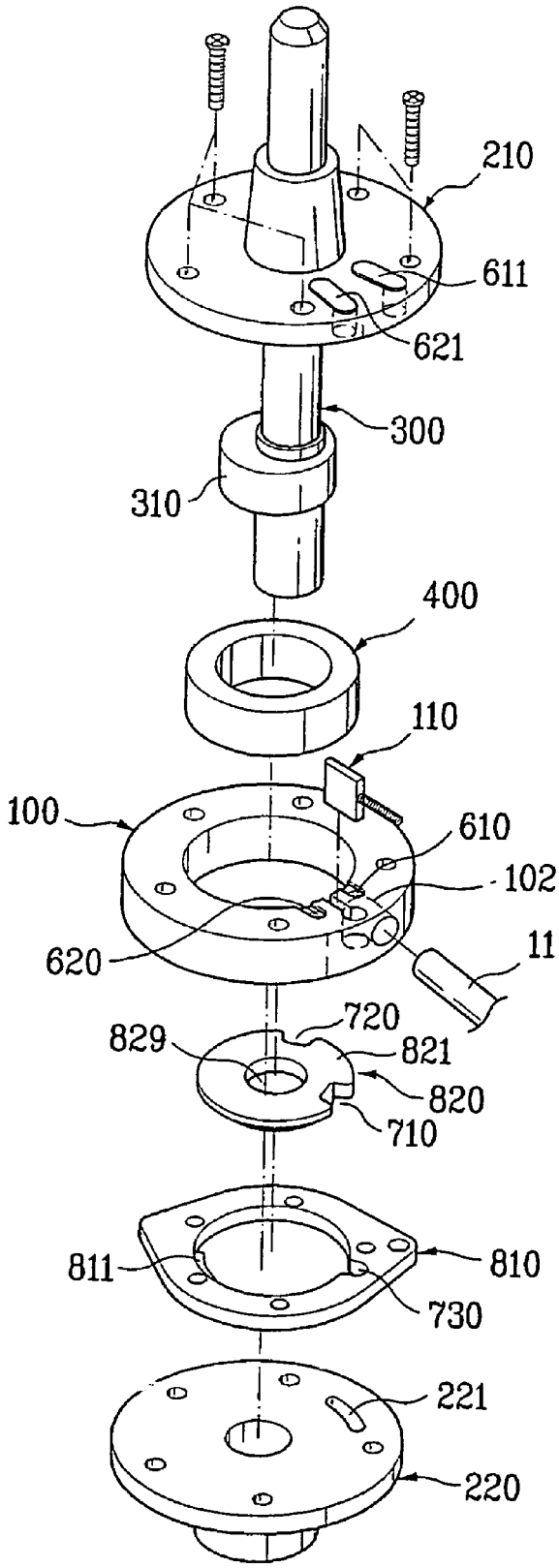
FIG. 8 is an exploded perspective view of a rotary compressor according to a second embodiment of the present invention.

As shown in FIG. 6C, when the compression is completed, the first discharge port 610 formed on the left side of the vane 110 is opened to discharge the refrigerant. At this point, the second discharge port 620 disposed on the right side of the vane 110 maintains its closed state.

A series of above-described operating processes are continued unless the operation of the compressor is stopped or reversed.

Meanwhile, during operation in the high capacity operational mode, there may be a dead area as the second suction port 720 of the rotational valve 820 is located in the compression chamber 101.

Particularly, when considering the second suction port 720 is communicating with the first refrigerant flowing portion 823, the dead area may also be formed on the first refrigerant flowing portion 823, reducing the compression efficiency.

Therefore, in a second embodiment of the present invention, a second suction port 720 disposed out of the compression chamber 101 is proposed.

In other words, the second embodiment provides a valve assembly having a central axis, which is eccentric with respect to a central axis of the crankshaft 300. The second embodiment will be described in more detail with reference to FIGS. 8 to 12*b*.

The valve assembly of this embodiment comprises rotational and stationary valves 820 and 810 that are similar to those of the first embodiment.

In other words, the rotational valve 820 is provided with first and second suction ports 710 and 720, first and second stoppers 821 and 822, first and second fluid flowing portions 823 and 824, and a hook step 811.

The rotational valve 820 is further provided with a penetration hole 829 having a diameter greater than that of the crankshaft 300 by an eccentric distance of the valve assembly. The greater diameter of the penetration hole 829 enables the crank-shaft to smoothly rotate.

The eccentric distance of the valve assembly is designed such that the second suction port 720 of the rotational valve 820 is located out of the compression chamber 101 in the high capacity operational mode and is located in the compression chamber 101 in the low capacity operational mode.

The third refrigerant flowing portion 221 formed on the top of the lower bearing 220 is formed on a location displaced by the eccentric distance so that the third suction port 730 of the stationary valve 820 and the second refrigerant flowing portion 824 of the rotational suction port 730 can communicate with each other.

The operation of the rotary compressor of this embodiment will be described in more detail hereinafter.

FIGS. 9A to 10B show an operation of the rotary compressor in the high capacity operational mode.

In the high capacity operational mode, the crankshaft 300 rotates counterclockwise and the roller 400 eccentrically rotates in the compression chamber 101 in association with the rotation of the crankshaft 300.

Figure 10A:
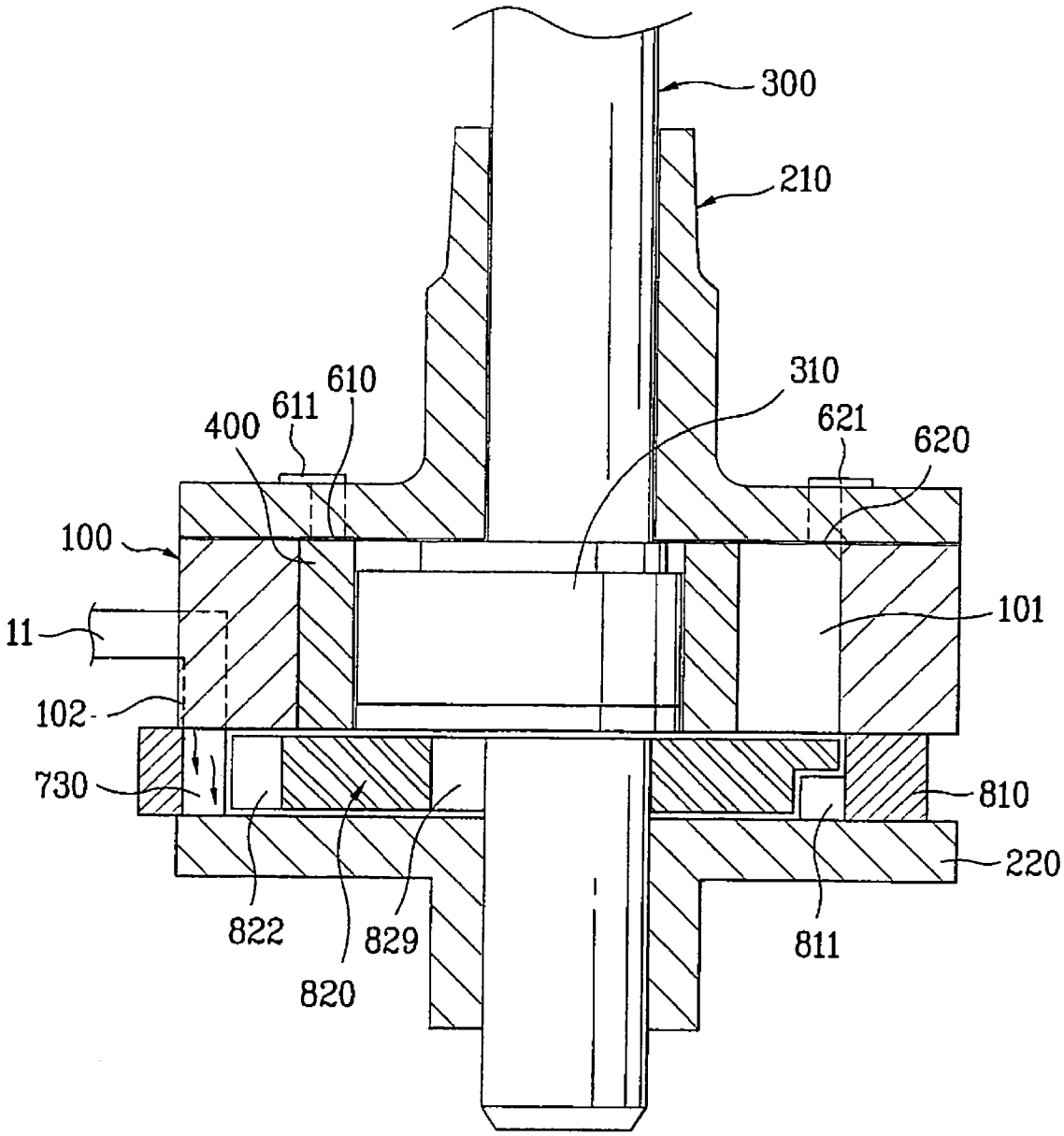
FIG. 10A is a sectional view taken along the line V-V of FIG. 9A.
Figure 10B:
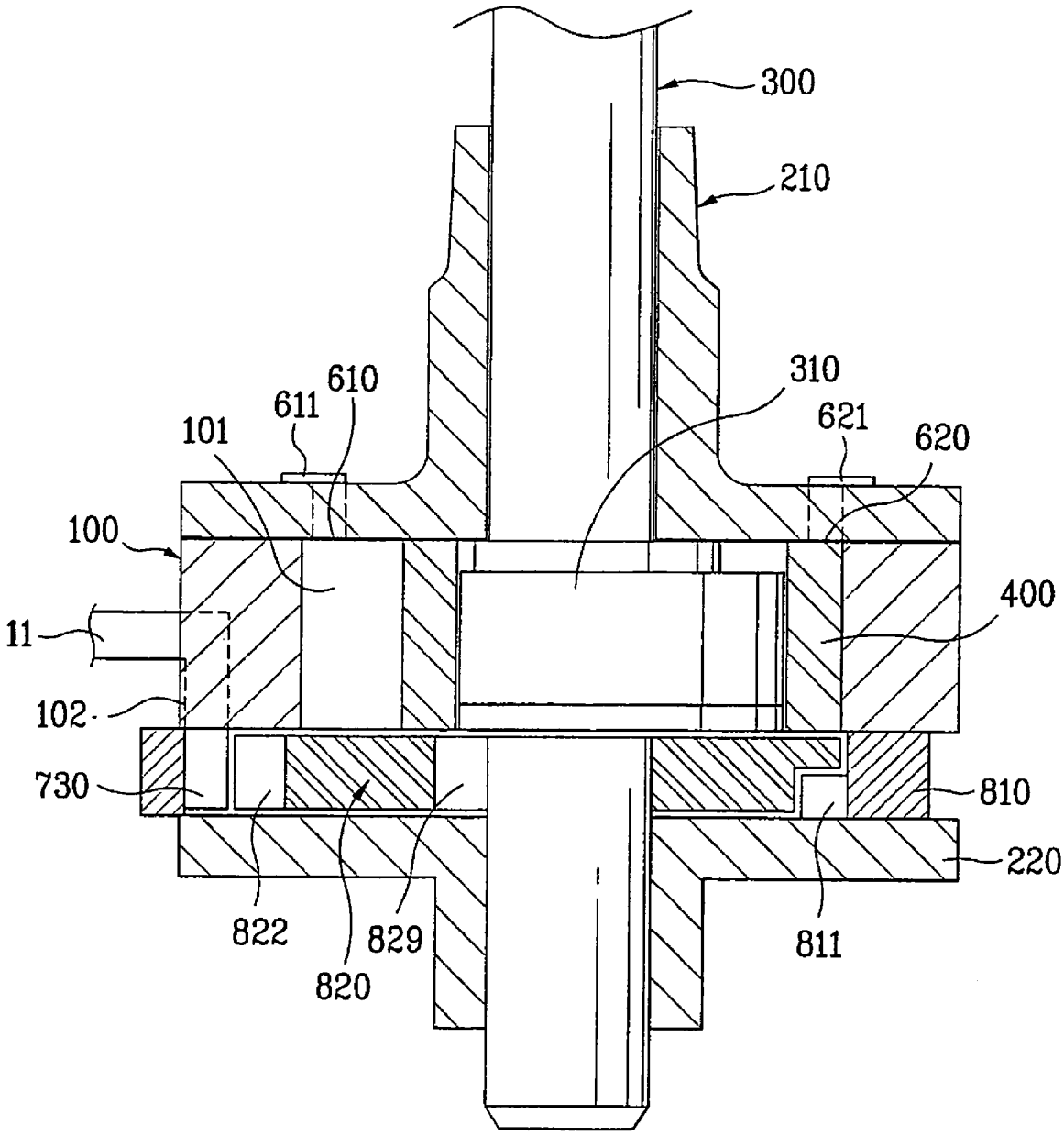
FIG. 10B is a sectional view taken along the line VI-VI of FIG. 9C.

At this point, the refrigerant fed into the compressor is directed to the third suction port 730 through a first communication hole 102 of the cylinder 100, and the roller 400 mounted around the eccentric portion 310 of the crankshaft 300 eccentrically rotates (i.e., rotates from a state shown in FIG. 10*a* to a state shown in FIG. 10B.)

As the roller rotates, fluid between the bottom of the roller 400 and the rotational valve 820 flows in the rotational direction of the roller.

At this point, viscosity of the fluid allows the rotational valve 820 to rotate in the rotational direction (counterclockwise) of the roller 400.

When the first stopper 821 is caught by the hook step 811 formed on the inner circumference of the stationary valve 810 in the course of moving along the stationary valve 810, the rotation of the rotational valve 820 stops.

When the rotational valve 820 rotates counterclockwise, the first suction port 710 of the rotational valve 820 is located communicating with the third suction port 730 of the stationary valve 810.

As a result, the refrigerant fed to the third suction port 730 through the first communication hole 102 of the cylinder 100 is directly directed to the first suction port 710 formed on the rotational valve 820.

However, as the valve assembly is mounted to be eccentric with respect to the central axis of the crankshaft 300 (or a central axis of the compression chamber 101) by a predetermined distance in a predetermined direction, the second suction port 720 is closed in a state where it is disposed out of the compression chamber 101.

Figure 9A:
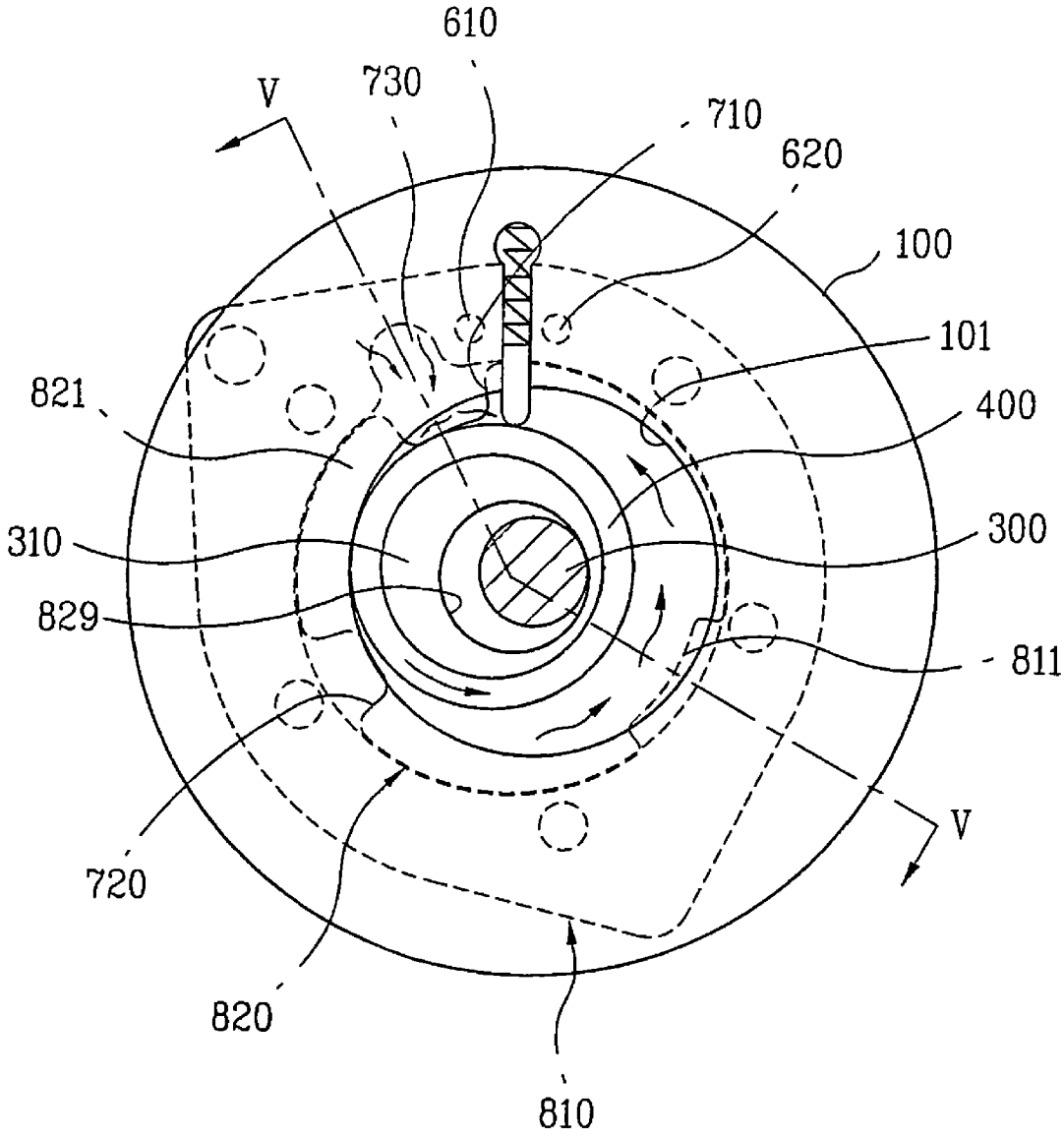
FIGS. 9A to 9C are sectional views illustrating a rotary compressor, which is operated in a high capacity operational mode, according to a first embodiment of the present invention.
Figure 9B:
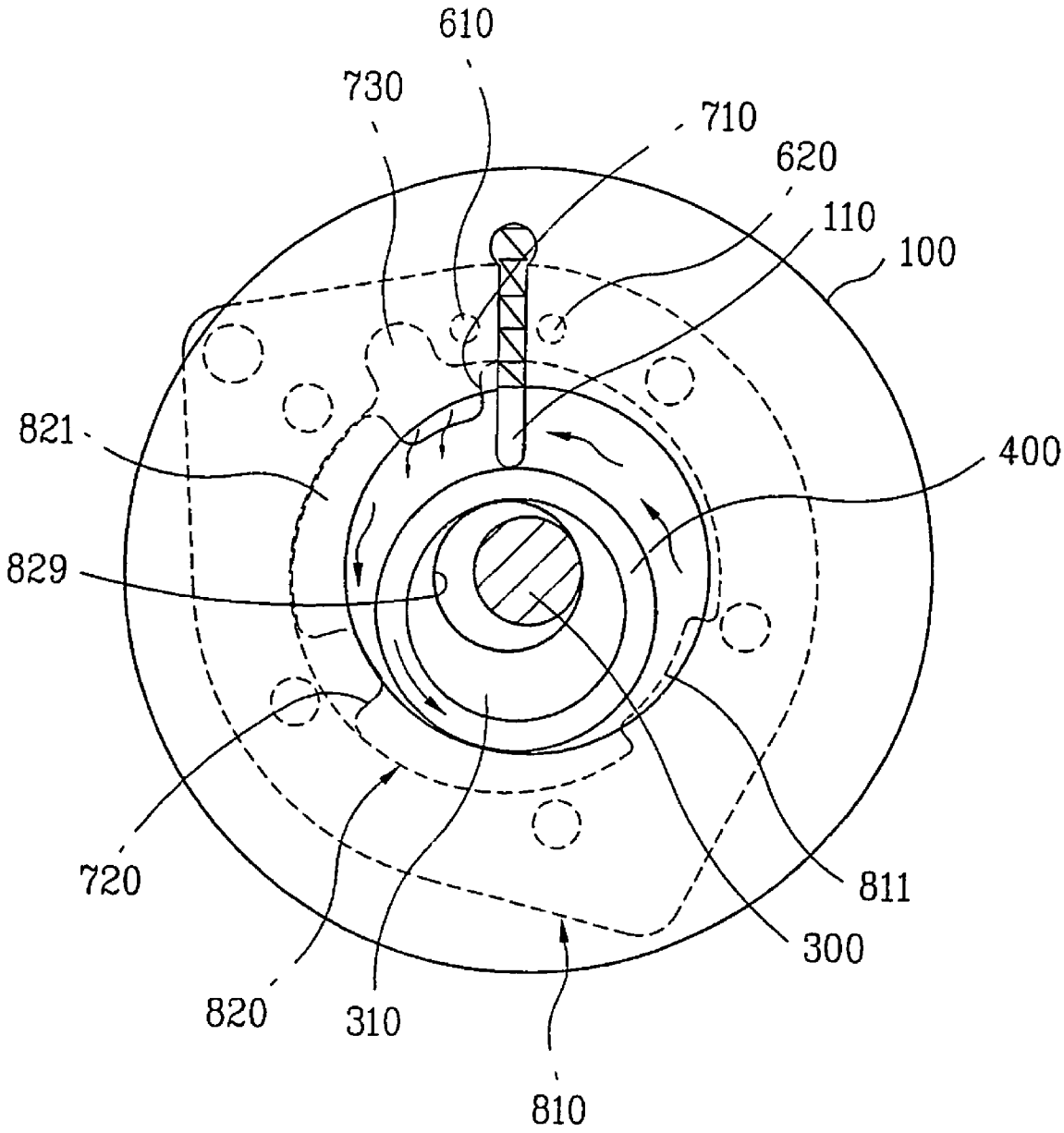

Accordingly, the refrigerant fed to the first suction port 710 is directed into the compression chamber 101 by a pressure difference, and is then gradually compressed as the roller eccentrically rotates together with the rotation of the crankshaft 400 and the eccentric portion 310 as shown in FIGS. 9A and 9B.

Figure 9C:
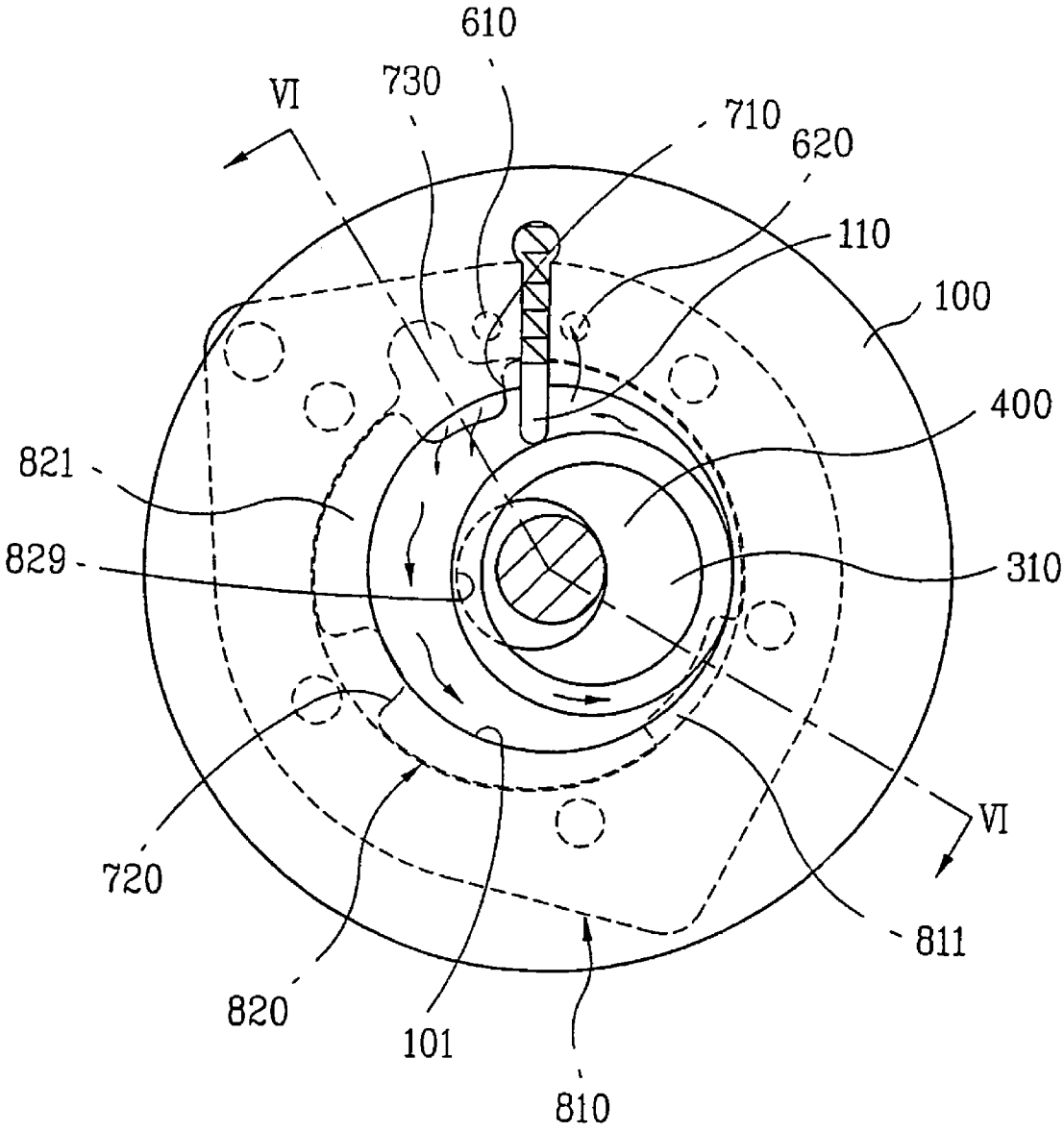

When the compression is completed as shown in FIG. 9C, the second discharge port 620 disposed on a right side of the vane 110 in the drawing is opened to discharge the compressed refrigerant. At this point, the first discharge port 610 disposed on a left side of the vane in the drawing remains in the closed state.

A series of above-described operating processes are continued unless the operation of the compressor is stopped or reversed.

Figure 12A:
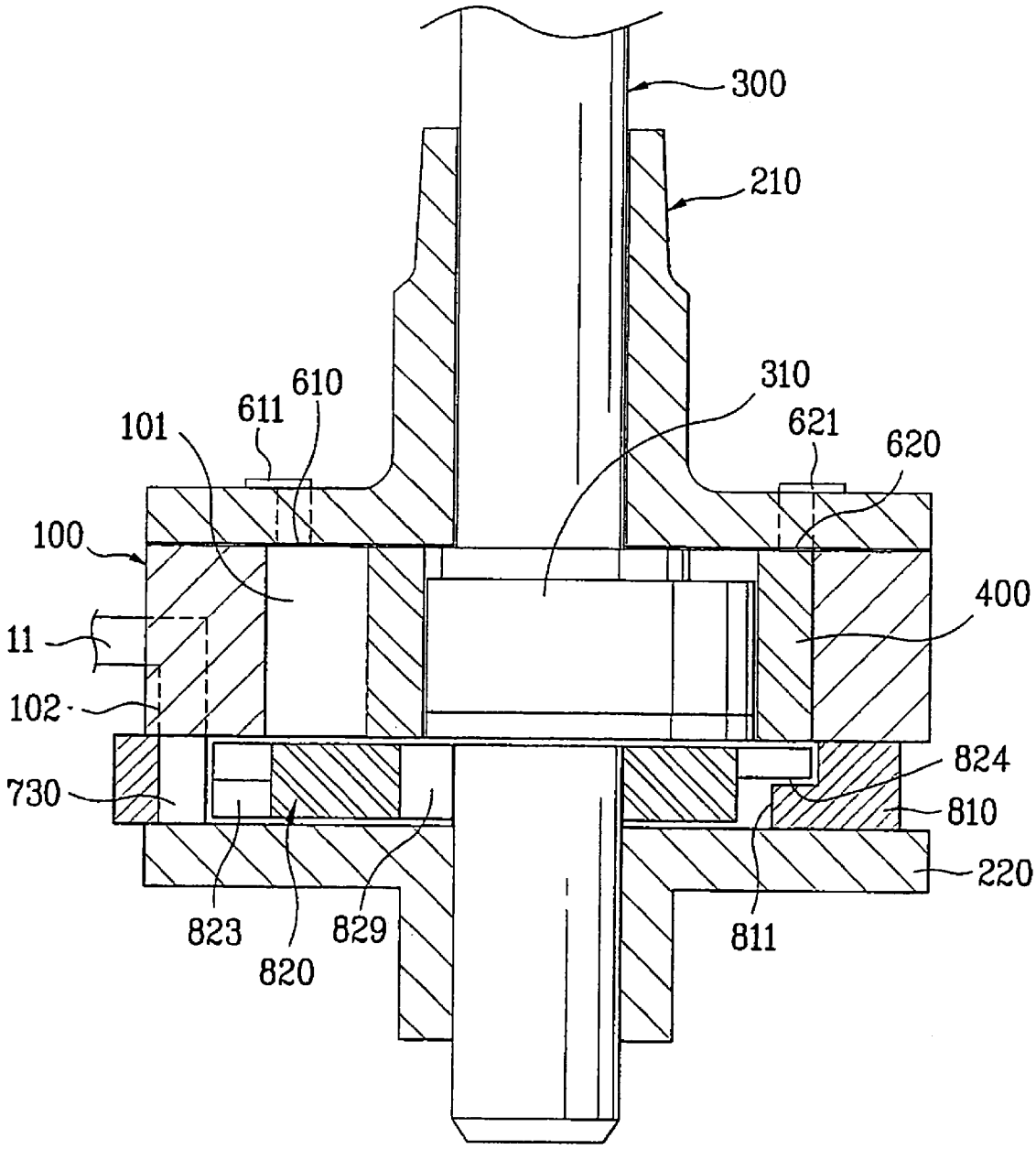
FIG. 12A is a sectional view taken along the line VII-VII of FIG. 11A.
Figure 12B:
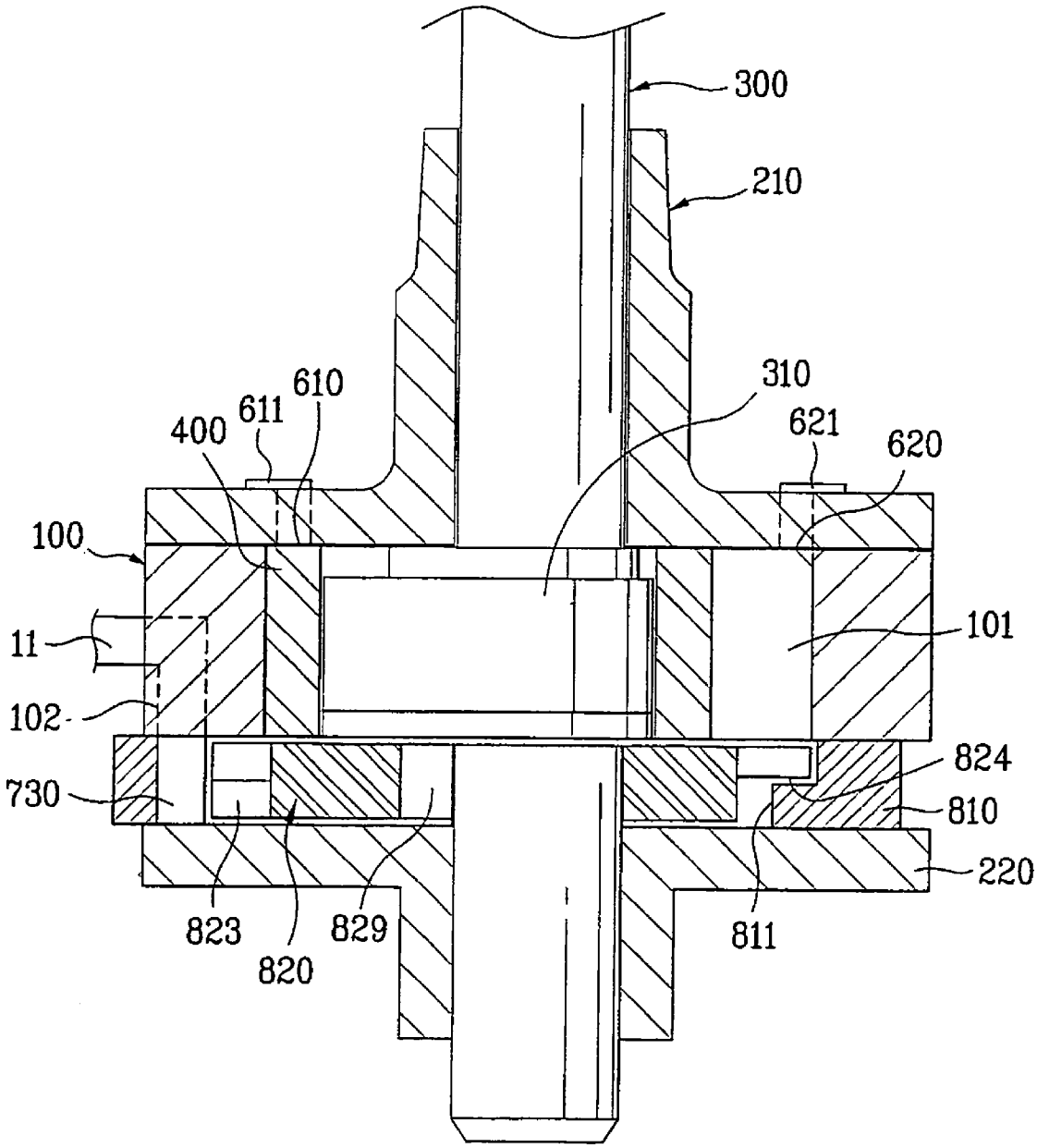
FIG. 12B is a sectional view taken along the line VIII-VIII of FIG. 11C.

When the operation mode is converted into the low capacity operational mode, the crankshaft 300 rotates clockwise from a state shown in FIG. 12*a* to a state shown in FIG. 12B.

The rotation of the crankshaft 300 allows the roller 400 to rotate, by which the fluid between the bottom of the roller 400 and the rotational valve 820 flows in the rotational direction of the roller 400. At this point, viscosity of the fluid lets the rotational valve 820 rotate in the rotational direction of the roller 400.

The above process is identical to that in the high capacity operational mode except for the rotational direction of the roller 400 and the flowing direction of the refrigerant.

When the second stopper 821 of the rotational valve 820 is caught by the hook step 811 formed on the inner circumference of the stationary valve 810, the rotation of the rotational valve 820 stops.

When the rotational valve 820 rotates clockwise as described above, the space for receiving the refrigerant is defined at a right side of the vane 110, and the space for compression is defined at a left side of the vane 10.

The second suction port 720 of the rotational valve 820 is disposed adjacent to the right side of the vane 110, and the first suction port 710 of the rotational valve 820 is located on a portion corresponding to the hook step 811 of the stationary valve 810.

At this point, the second suction port 720 communicates with the third suction port 730 of the stationary valve 810 by the first refrigerant flowing portion 823, and the first suction port 710 communicates with the third suction port 730 of the stationary valve 810 by the second refrigerant flowing portion 824 and the third refrigerant flowing portion 221 formed on the top of the lower bearing 220.

Accordingly, the refrigerant fed to the third suction port 730 through the first communication hole 102 of the cylinder 100 is directed to the second suction port 720 through the first refrigerant flowing portion 823 formed on the rotational valve 820 and is further directed to the compression chamber 101 through the second and third refrigerant flowing portions 824 and 221.

Figure 11A:
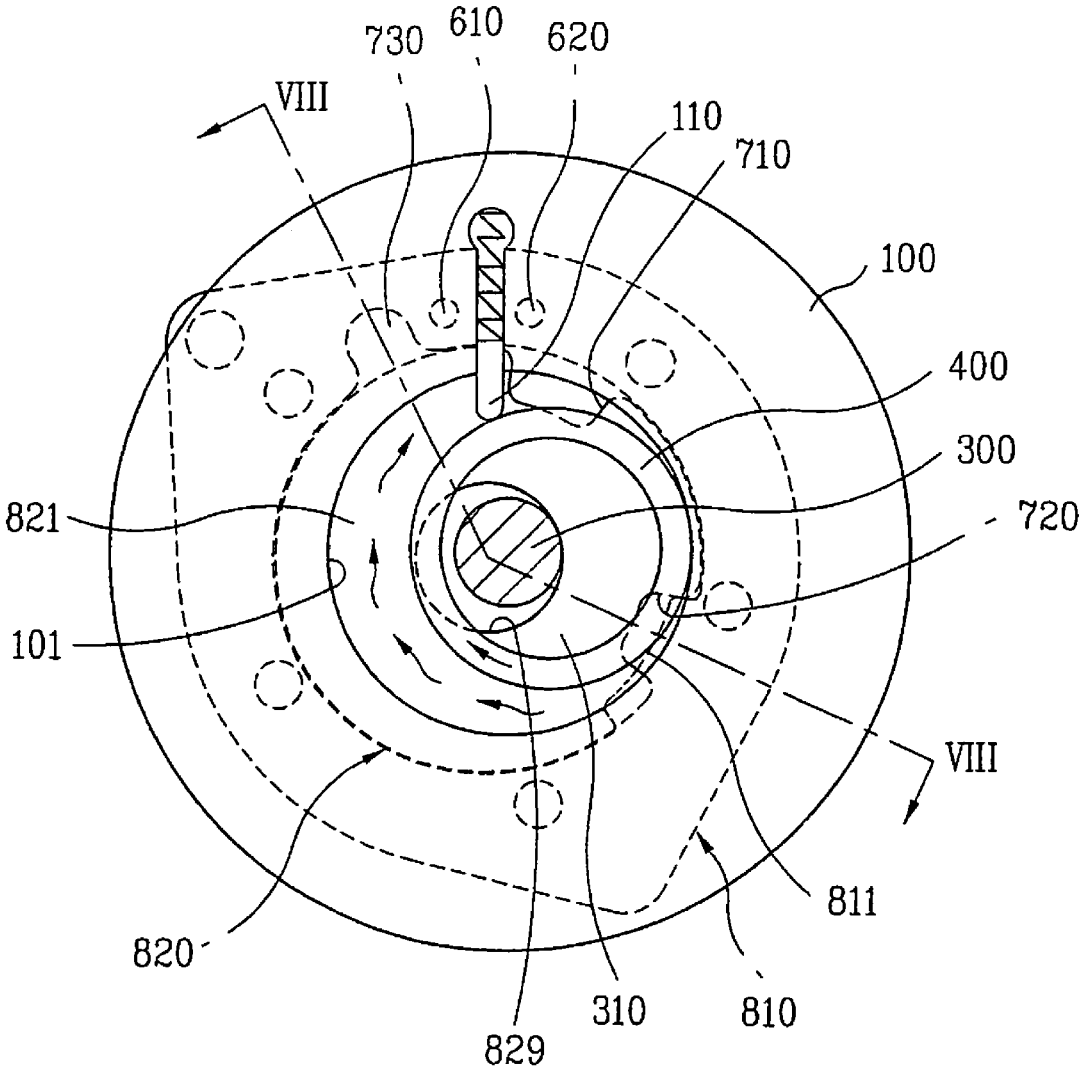
FIGS. 11A to 11C are sectional views illustrating a rotary compressor, which is operated in a low capacity operational mode, according to a second embodiment of the present invention.
Figure 11B:
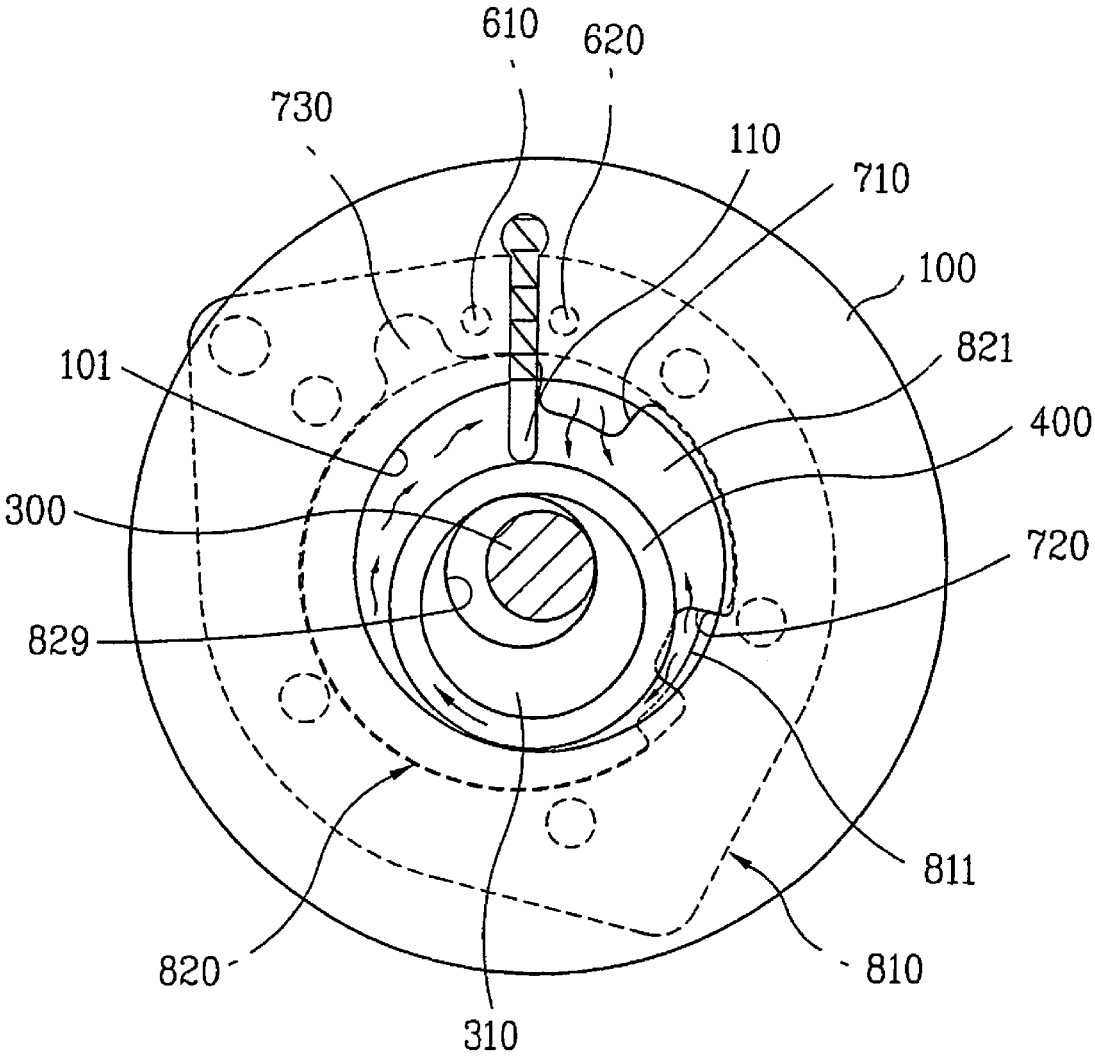

The compression of the refrigerant fed into the compression chamber 101 starts from a point where the roller 400, eccentrically rotating and rolling, passes the first suction port 720, and it gradually proceeds as shown in FIGS. 11A and 11B.

At this point, the refrigerant fed into the compression chamber 101 through the second suction port 720 prevents the inner space of the compression chamber 101 from being under vacuum until it reaches a position where the first suction port 710 communicates after it passes through a position where the vane 110 is located, thereby reducing noise caused by vacuum and improving the compression efficiency.

Figure 11C:
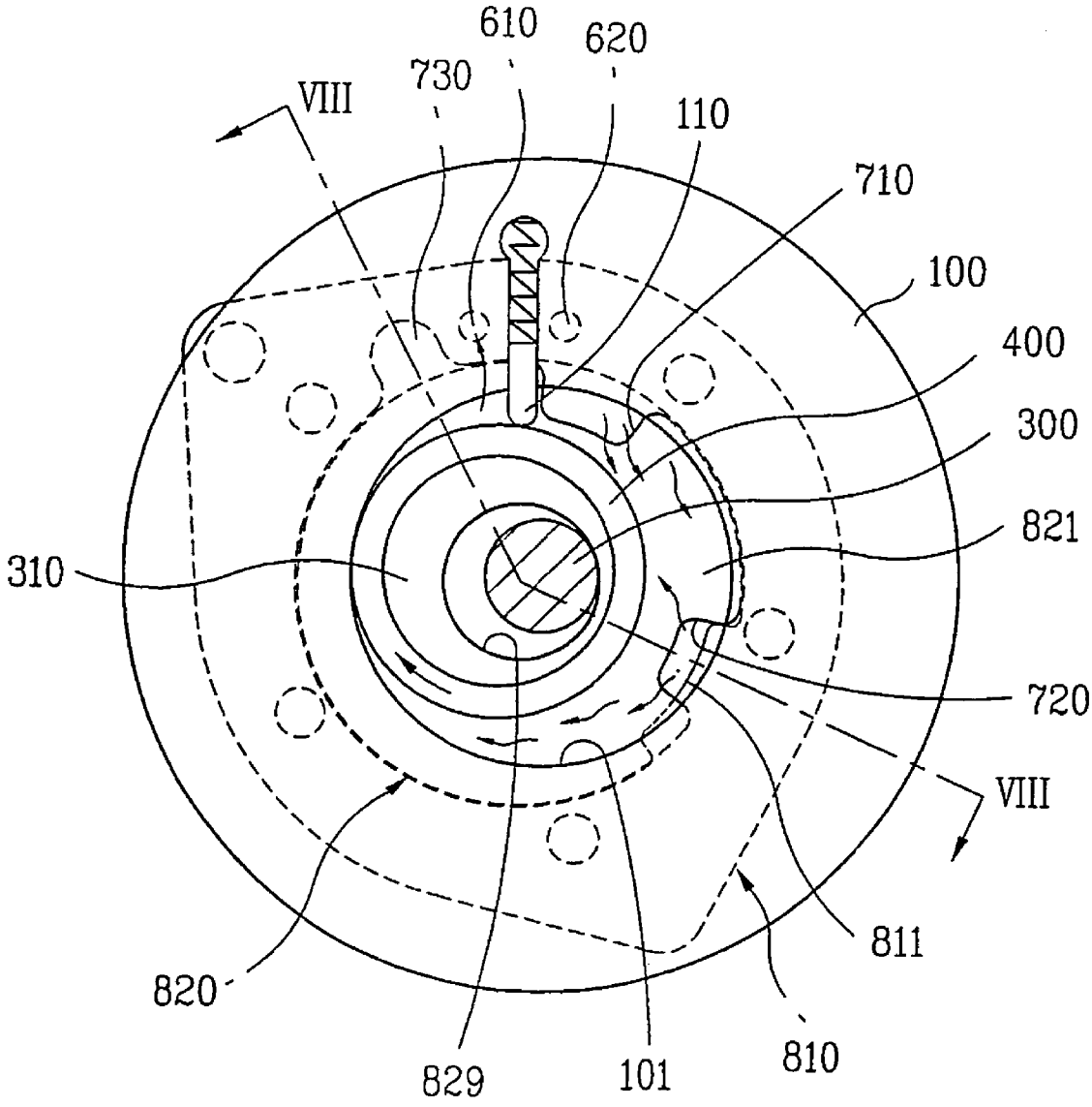

As shown in FIG. 11C, when the compression is completed, the first discharge port 610 formed on the left side of the vane 110 is opened to discharge the refrigerant. At this point, the second discharge port 620 disposed on the right side of the vane 110 maintains its closed state.

A series of above-described operating processes are continued unless the operation of the compressor is stopped or reversed.

Ideally, no oil should be contained in the refrigerant to be compressed to improve the compression efficiency. However, a small amount of oil will be contained in the refrigerant fed into the cylinder 100 from an accumulator or the like, deteriorating the compression efficiency.

Particularly, in the high capacity operational mode, since the first suction port 710 of the rotational valve 820 is directly communicated with the third suction port 730, the fluid is poured into the compression chamber 101 without being discharged to the outside.

Furthermore, since an amount of refrigerant fed to the third suction port 730 is varied due to the uneven pouring pressure of the accumulator, an amount of the refrigerant fed into the compression chamber 101 through the first suction port 710 is also varied, as a result of which desired compression efficiency cannot be obtained.

Therefore, a third embodiment of the present invention is proposed to solve the above-described problems of the second embodiment.

Figure 13:
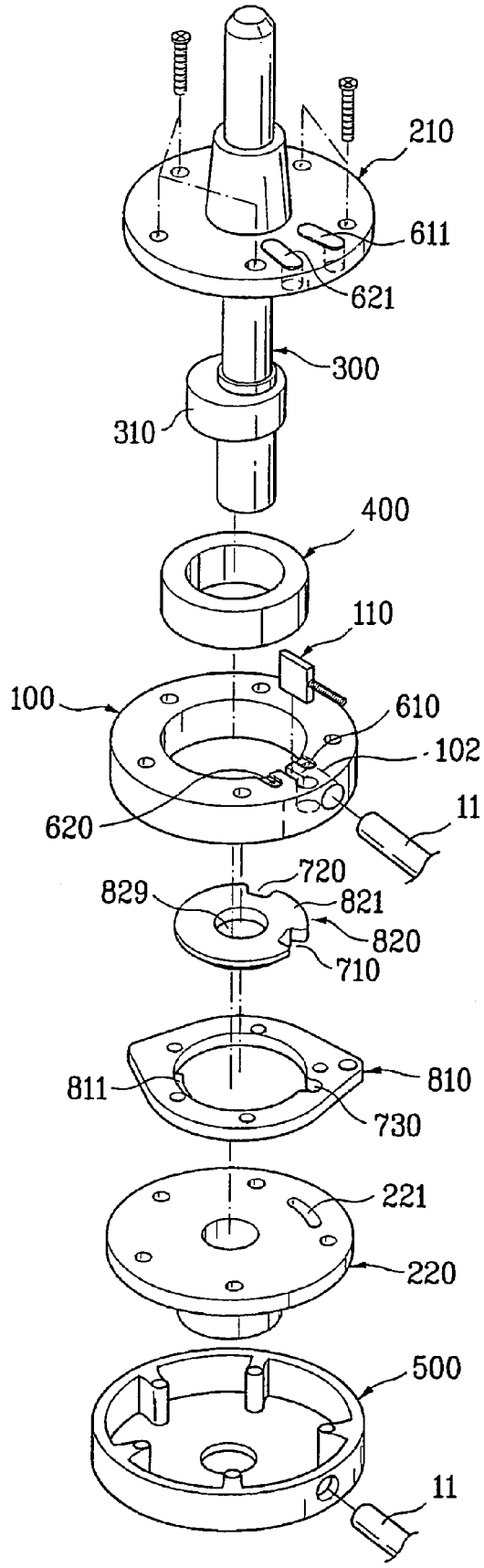
FIG. 13 is an exploded perspective view of a rotary compressor according to a third embodiment of the present invention.
Figure 14A:
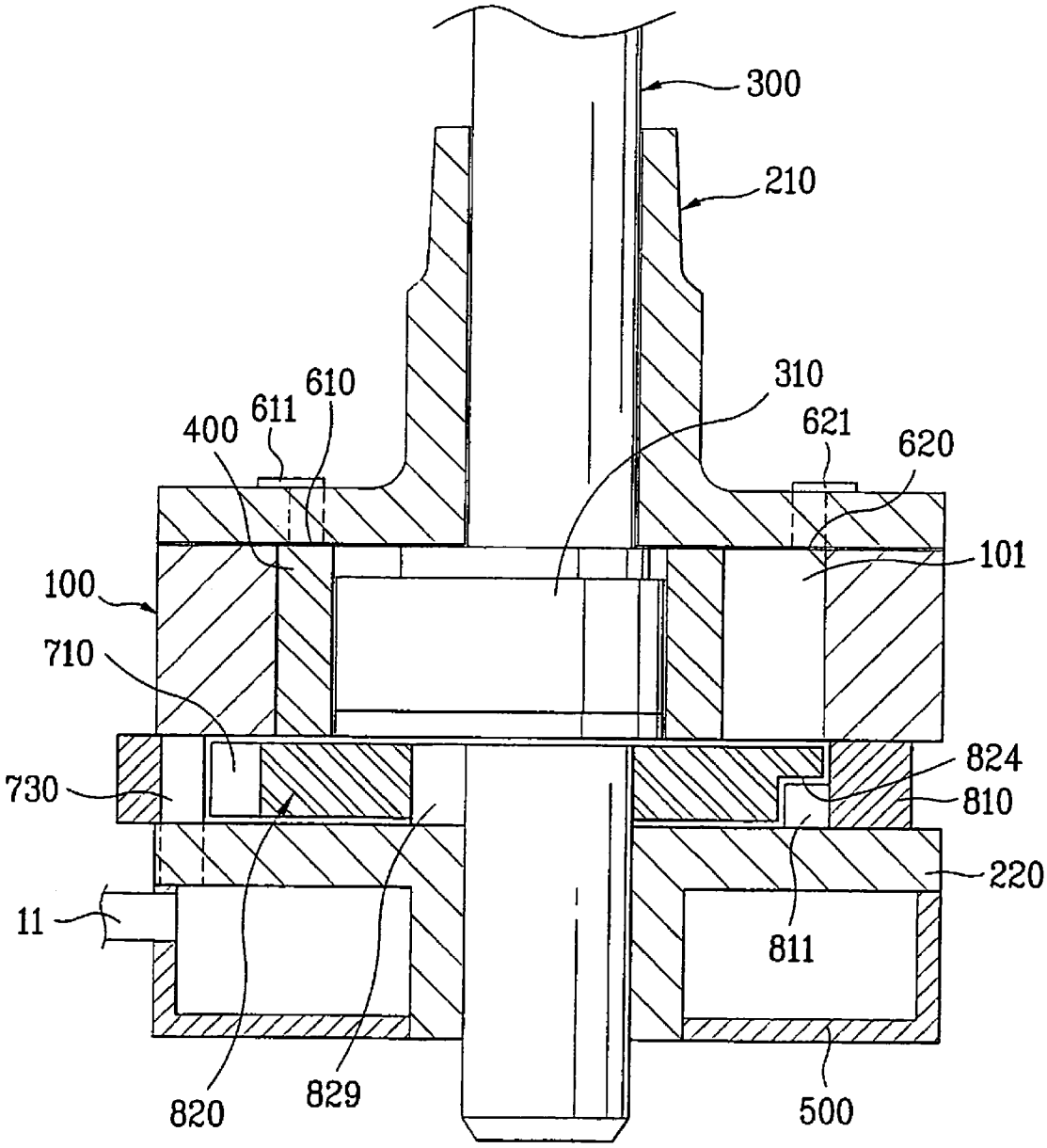
FIGS. 14A and 14B are sectional views illustrating operational modes of a rotary compressor according to a third embodiment of the present invention.
Figure 14B:
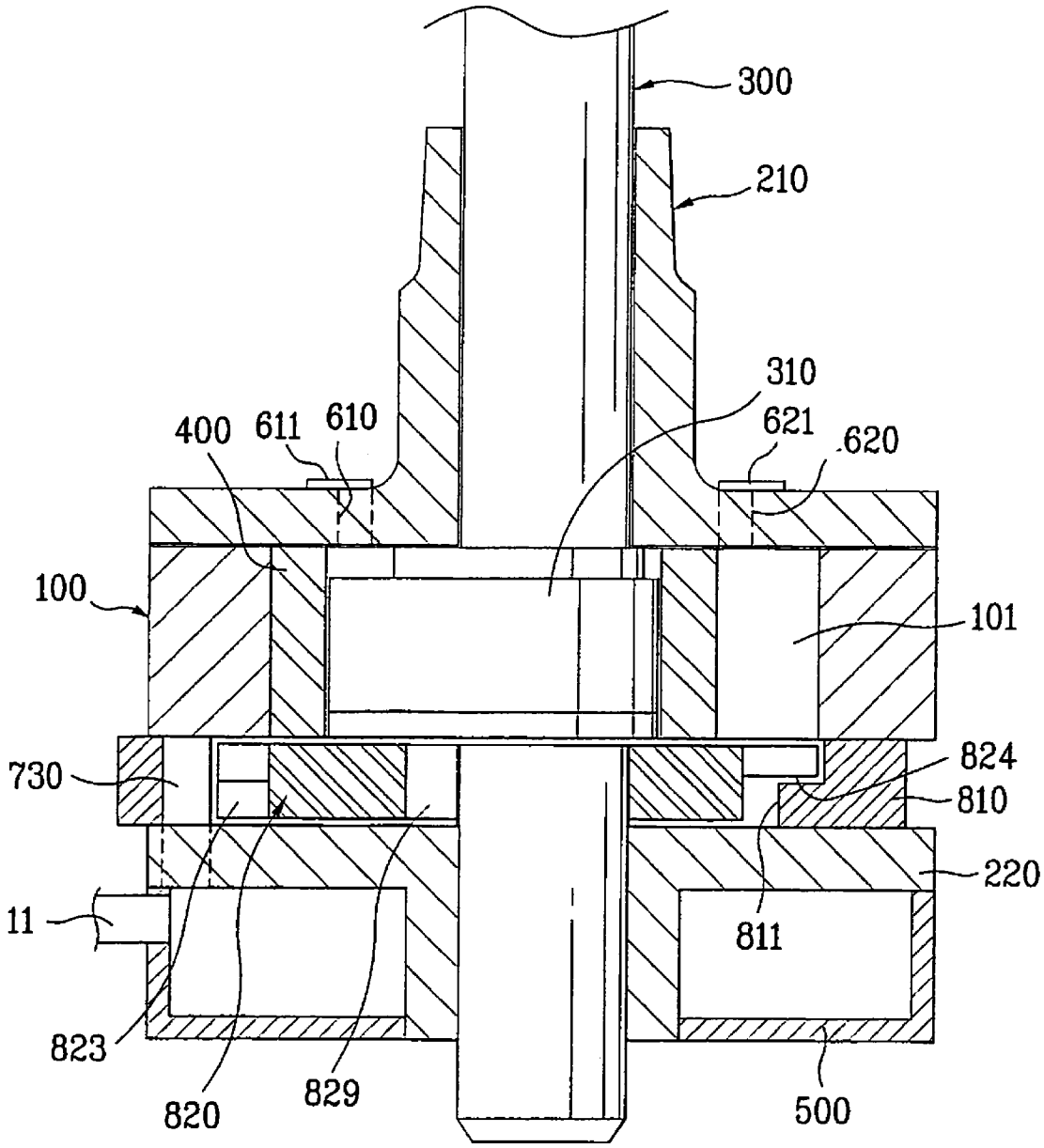

In the third embodiment, as shown in FIGS. 13 to 14B, a refrigerant storing portion 500 for storing the refrigerant fed from the outside and supplying the stored refrigerant to the valve assembly is further provided under the lower bearing 220.

The valve assembly of this embodiment comprises rotational and stationary valves 820 and 810 that are identical to those of the second embodiment.

The refrigerant storing portion 500 is connected to an outer refrigerant storing container such as an accumulator by a refrigerant tube 11. The lower bearing 220 is provided with at least one second communication hole 222 communicating with an inner space of the refrigerant storing portion 500.

The second communication hole 222 is formed corresponding to the third suction port 730 of the stationary valve 810.

It is also possible that the lower bearing 220 is provided with a communication hole (not shown) disposed corresponding to a position where the first suction port 710 of the rotational valve 820 is located during the operation in the high capacity operational mode, and another communication hole (not shown) disposed corresponding to a position where the first suction port 710 of the rotational valve 820 is located during the operation in the low capacity operational mode.

The refrigerant is first fed from the outer refrigerant storing member into the refrigerant storing portion 500 through the refrigerant tube 11, and is then directed to the third suction port 730 through the second communication hole 222. The refrigerant directed to the third suction port 730 is further directed to the second refrigerant flowing portion 824 or directly to the first suction port 710 of the rotational valve 820. The refrigerant is then fed into the compression chamber 101 through the second suction port 720 by the first refrigerant flowing portion 823.

At this point, although the refrigerant flowing into the refrigerant storing portion 500 contains a predetermined amount of oil, the refrigerant and the oil are separated from each other in the refrigerant storing portion 500 due to a difference in their specific gravities. In other words, the oil is disposed beneath the refrigerant in the storing portion 500. Therefore, only the refrigerant is discharged to the third suction port 730.

Accordingly, little oil is contained in the refrigerant fed into the compressing chamber 101, improving the compression efficiency.

Furthermore, even when the refrigerant is unevenly supplied from the accumulator, since the refrigerant is discharged after being stored in the storing chamber, the refrigerant can be evenly fed to the third suction port 730.

Particularly, since the refrigerant storing portion functions as the accumulator, a separate accumulator can be omitted.

Here, FIG. 14A shows a rotary compressor in the high capacity operational mode, and FIG. 14B shows a rotary compressor in the low capacity operational mode.

Figure 15:
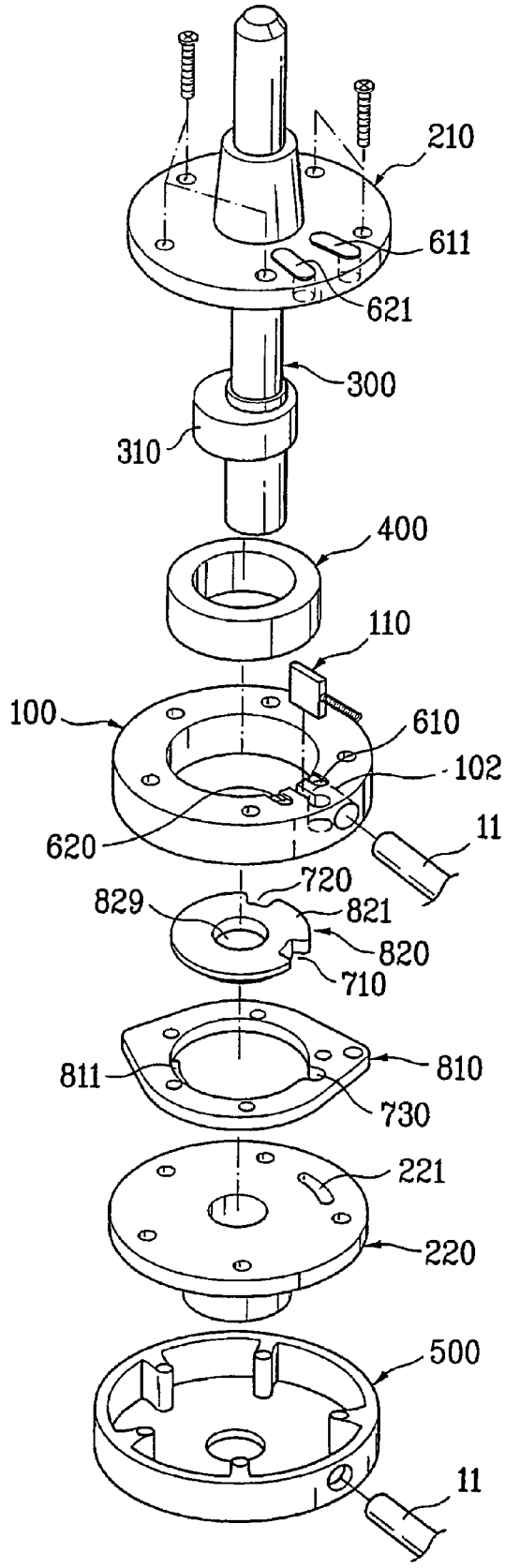
FIG. 15 is an exploded perspective view of a rotary compressor according to a fourth embodiment of the present invention.

FIG. 15 shows a rotary compressor according to a fourth embodiment of the present invention.

In the third embodiment, the refrigerant storing portion 500 is applied to a compressor designed as in the second embodiment having the eccentric valve assembly. However, in this fourth embodiment, the refrigerant storing portion 500 is applied to a compressor designed as in the first embodiment.

In this fourth embodiment, since the valve assembly is not eccentric with respect to the central axis of the compression chamber 101, the problem of the dead area remains. However, as the mixture of oil with the refrigerant can be minimized, the compression efficiency can be improved when compared with the first embodiment.

Furthermore, the disposition of the valve assembly is not limited to the above-described embodiments. In other words, the valve assembly can be disposed between is the cylinder 100 and the upper bearing 210.

As described above, the rotary container of the present invention has a following variety of advantages.

First, since the container is designed to operate in a variety of modes each having a different compression capacity, it can be applied to a variety of applications, i.e., by simply converting the rotational direction of the crankshaft the container can operate in either high or low capacity operational modes.

Second, since the dead area can be eliminated by the eccentric valve assembly, the compression efficiency can be remarkably improved;

Third, since the refrigerant can be uniformly supplied to the compression chamber by adding the refrigerant storing portion, the desired compression efficiency can be obtained.

Fourth, by separating oil from the refrigerant fed from the compression chamber as large as possible, the deterioration of the compression efficiency, which may be caused by the oil, can be prevented.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A rotary compressor comprising:

a cylinder having a vane for partitioning an inner space of the cylinder into a compression section and a suction section;

upper and lower bearings respectively disposed on top and bottom of the cylinder, for defining a compression chamber by hermetically sealing the inner space of the cylinder;

a crankshaft installed to penetrate the cylinder, the upper bearing, and having an eccentric portion at an outer circumference thereof;

at least one discharge port communicating with the compression chamber, and through which compressed refrigerant is discharged;

a valve assembly having at least one suction port for selectively supplying refrigerant through two different positions inside the compression chamber according to a rotational direction of the crankshaft, and at least one refrigerant flowing portion for feeding the refrigerant to the suction port, the valve assembly comprising:

a stationary valve fixedly disposed between an outer periphery of the cylinder and an outer periphery of one of the upper and lower bearings; and a rotational valve rotatably mounted along an outer circumference of the stationary valve.

2. The rotary compressor of claim 1, wherein the stationary valve is ring-shaped with a predetermined thickness, and has an inner circumference along which the rotational valve rotates, and the rotational valve is disk-shaped with a thickness identical to that of the stationary valve, the rotational valve being provided with a penetration hole through which the crankshaft passes.

3. The rotary compressor of claim 1, wherein the rotational valve is provided with first and second suction ports for selectively delivering the refrigerant fed from an outside into the compression chamber according to a desired compression capacity.

4. The rotary compressor of claim 3, wherein the first and second suction ports are formed by cutting away portions of the outer circumference of the rotational valve.

5. The rotary compressor of claim 3, wherein the first and second suction ports are spaced apart from each other by a predetermined distance.

6. The rotary compressor of claim 5, wherein the predetermined distance between the suction ports corresponds to a place where in a low capacity operational mode, the first suction port feeds a predetermined amount of the refrigerant necessary for a corresponding refrigerant compression ratio and at the same time to a place of a space side where the refrigerant is sucked among portions adjacent to the vane.

7. The rotary compressor of claim 3, wherein the stationary valve is provided at its inner circumference with a hook step, and the rotational valve is provided with a stopper caught by the hook step according to a rotational direction of the rotational valve, the stopper being formed on an inner circumference of the rotational valve.

8. The rotary compressor of claim 7, wherein the stopper of the rotational valve comprises:

a first stopper caught by the hook step of the stationary valve when the rotational valve rotates for an operation under a high capacity compression ratio mode; and a second stopper caught by the hook step of the stationary valve when the rotational valve rotates for an operation under a low capacity compression ratio mode.

9. The rotary compressor of claim 8, wherein the first stopper is formed such that the first and second suction ports of the rotational valve are positioned at both sides thereof, and the second stopper is formed to be spaced apart from the first stopper by a predetermined distance.

10. The rotary compressor of claim 3, wherein the stationary valve comprises a third suction port which is supplied with refrigerant from an outside to selectively deliver the refrigerant to the first suction port or the second suction port.

11. The rotary compressor of claim 10, wherein the third suction port is formed by indenting the inner circumference of the stationary valve.

12. The rotary compressor of claim 11, wherein the third suction port is positioned adjacent to one side of the vane.

13. The rotary compressor of claim 10 wherein the cylinder is provided with a communication hole for delivering the refrigerant to the third suction port.

14. The rotary compressor of claim 8 or 10, wherein the refrigerant flowing portion comprises:

a first refrigerant flowing portion for communicating the third suction port of the stationary valve with the second suction port of the rotational suction port for an operation under a low capacity compression ratio mode in a state that the rotational valve is rotated; and a second refrigerant flowing portion for extending communication from an end of the second stopper of the rotational valve to the first suction port.

15. The rotary compressor of claim 14, wherein the refrigerant flowing portion is comprised of an indent groove formed by indenting a lower periphery of the rotational valve by a predetermined thickness.

16. The compressor of claim 14, wherein one of the upper and lower bearings facing the respective suction ports is further provided with a third refrigerant flowing portion for communicating the third suction port of the stationary valve with the first suction port in a state that the rotational valve rotates for an operation under a low capacity compression ratio.

17. The rotary compressor of claim 1, wherein the valve assembly has a center which is eccentric by a predetermined distance from a central axis of the crankshaft toward a direction.

18. The rotary compressor of claim 17, wherein the stationary valve is ring-shaped with a predetermined thickness, and has an inner circumference along which the rotational valve rotates, and the rotational valve is disk-shaped with a thickness identical to that of the stationary valve, the rotational valve being provided with a penetration hole through which the crankshaft passes.

19. The rotary compressor of claim 17, wherein the rotational valve is provided with first and second suction ports for selectively delivering the refrigerant fed from an outside into the compression chamber according to a desired compression capacity.

20. The rotary compressor of claim 19, wherein the first and second suction ports are formed by cutting away portions of the outer circumference of the rotational valve.

21. The rotary compressor of claim 19, wherein the first and second suction ports are spaced apart from each other by a predetermined distance.

22. The rotary compressor of claim 21, wherein the predetermined distance between the suction ports corresponds to a place where in a low capacity operational mode, the first suction port feeds a predetermined amount of the refrigerant necessary for a corresponding refrigerant compression ratio and at the same time to a place of a space side where the refrigerant is sucked among portions adjacent to the vane.

23. The rotary compressor of claim 19, wherein the stationary valve is provided at its inner circumference with a hook step, and the rotational valve is provided with a stopper caught by the hook step according to a rotational direction of the rotational valve, the stopper being formed on an inner circumference of the rotational valve.

24. The rotary compressor of claim 23, wherein the stopper of the rotational valve comprises:

a first stopper caught by the hook step of the stationary valve when the rotational valve rotates for an operation under a high capacity compression ratio mode; and a second stopper caught by the hook step of the stationary valve when the rotational valve rotates for an operation under a low capacity compression ratio mode.

25. The rotary compressor of claim 24, wherein the first stopper is formed such that the first and second suction ports of the rotational valve are positioned at both sides thereof, and the second stopper is formed to be spaced apart from the first stopper by a predetermined distance.

26. The rotary compressor of claim 19, wherein the stationary valve comprises a third suction port which is supplied with refrigerant from an outside to selectively deliver the refrigerant to the first suction port or the second suction port.

27. The rotary compressor of claim 26, wherein the third suction port is formed by indenting the inner circumference of the stationary valve.

28. The rotary compressor of claim 27, wherein the third suction port is positioned adjacent to one side of the vane.

29. The rotary compressor of claim 26, wherein the cylinder is provided with a communication hole for delivering the refrigerant to the third suction port.

30. The rotary compressor of claim 24 or 26, wherein the refrigerant flowing portion comprises:

a first refrigerant flowing portion for communicating the third suction port of the stationary valve with the second suction port of the rotational suction port for an operation of a low capacity compression ratio mode in a state that the rotational valve is rotated; and a second refrigerant flowing portion for extending communication from an end of the second stopper of the rotational valve to the first suction port.

31. The rotary compressor of claim 30, wherein the refrigerant flowing portion is comprised of an indent groove formed by indenting a lower periphery of the rotational valve by a predetermined thickness.

32. The compressor of claim 30, wherein one of the upper and lower bearings facing the respective suction ports is further provided with a third refrigerant flowing portion for communicating the third suction port of the stationary valve with the first suction port in a state that the rotational valve rotates for an operation under a low capacity compression ratio.

33. The rotary compressor of claim 17 or 18, further comprising a refrigerant storing portion having a predetermined space for being supplied with the refrigerant from an outside, storing the supplied refrigerant and selectively feeding the stored refrigerant to the valve assembly, the refrigerant storing portion being provided along a lower periphery of the lower bearing.

34. The rotary compressor of claim 33, wherein the refrigerant storing portion has an opened top and is mounted to surround a lower periphery of the lower bearing.

35. The rotary compressor of claim 34, wherein the lower bearing is provided, on a face of the lower bearing facing the installation position of the refrigerant storing portion, with at least one communication hole communicating with an inner space of the refrigerant storing portion.

36. The rotary compressor of claim 35, wherein the communication hole is configured to communicate with a portion where the third suction port of the stationary valve is located.

37. The rotary compressor of claim 34, wherein the lower bearing is provided, on a face of the lower bearing facing the installation position of the refrigerant storing portion, with at least one communication hole communicating with an inner space of the refrigerant storing portion.

38. The rotary compressor of any one of claims 17 and 20, wherein an eccentric distance of the valve assembly corresponds to such a distance that the second suction portion is located outside the compression chamber in an operation of a high capacity refrigerant compression mode and at the same time the second suction port is located inside the compression chamber in an operation of a low capacity refrigerant compression mode.

39. The rotary compressor of claim 1, further comprising a refrigerant storing portion having a predetermined space for being supplied with the refrigerant from an outside, storing the supplied refrigerant and selectively feeding the stored refrigerant to the valve assembly, the refrigerant storing portion being provided along a lower periphery of the lower bearing.

40. The rotary compressor of claim 39, wherein the stationary valve is ring-shaped with a predetermined thickness, and has an inner circumference along which the rotational valve rotates, and the rotational valve is disk-shaped with a thickness identical to that of the stationary valve, the rotational valve being provided with a penetration hole through which the crankshaft passes.

41. The rotary compressor of claim 40, wherein the rotational valve is provided with first and second suction ports for selectively delivering the refrigerant fed from an outside into the compression chamber according to a desired compression capacity.

42. The rotary compressor of claim 41, wherein the stationary valve comprises a third suction port which is supplied with refrigerant from an outside to selectively deliver the refrigerant to the first suction port or the second suction port.

43. The rotary compressor of any one of claims 42 and 37, wherein the communication hole is configured to communicate with a portion where the third suction port of the stationary valve is located.

44. The rotary compressor of claim 40, wherein the stationary valve is provided at its inner circumference with a hook step, and the rotational valve is provided with a stopper caught by the hook step according to a rotational direction of the rotational valve, the stopper being formed on an inner circumference of the rotational valve.

45. The rotary compressor of claim 44, wherein the stopper of the rotational valve comprises:

a first stopper caught by the hook step of the stationary valve when the rotational valve rotates for an operation under a high capacity compression ratio mode; and a second stopper caught by the hook step of the stationary valve when the rotational valve rotates for an operation under a low capacity compression ratio mode.

46. The rotary compressor of claim 45, wherein the first stopper is formed such that the first and second suction ports of the rotational valve are positioned at both sides thereof, and the second stopper is formed to be spaced apart from the first stopper by a predetermined distance.

47. The rotary compressor of any one of claims 41 and 46, wherein the refrigerant flowing portion comprises:

a first refrigerant flowing portion for communicating the third suction port of the stationary valve with the second suction port of the rotational suction port for an operation of a low capacity compression ratio mode in a state that the rotational valve is rotated; and a second refrigerant flowing portion for extending communication from an end of the second stopper of the rotational valve to the first suction port.

48. The rotary compressor of claim 47, wherein the refrigerant flowing portion is comprised of an indent groove formed by indenting a lower periphery of the rotational valve by a predetermined thickness.

49. The rotary compressor of claim 39, wherein the refrigerant storing portion has an opened top and is mounted to surround a lower periphery of the lower bearing.

50. The rotary compressor of claim 1, wherein the discharge port comprises first and second discharge ports.

51. The rotary compressor of claim 50, wherein the first and second discharge ports are respectively formed on the cylinder.

52. The rotary compressor of claim 51, wherein the first and second discharge ports are located adjacent to both sides of the vane, respectively.

* * * * *